US006352114B1

(12) United States Patent
Toalson et al.

(10) Patent No.: US 6,352,114 B1
(45) Date of Patent: Mar. 5, 2002

(54) DEEP OCEAN RISER POSITIONING SYSTEM AND METHOD OF RUNNING CASING

(75) Inventors: David C. Toalson, Bellville; William A. Hunter, Katy; Roger W. Mowell, Houston, all of TX (US)

(73) Assignee: Ocean Drilling Technology, L.L.C., Houston, TX (US)

( * ) Notice: Subject to any disclaimer, the term of this patent is extended or adjusted under 35 U.S.C. 154(b) by 0 days.

(21) Appl. No.: 09/209,936

(22) Filed: Dec. 11, 1998

(51) Int. Cl.[7] ..... E21B 33/038

(52) U.S. Cl. ..... 166/343; 166/339; 166/345; 166/359; 175/7

(58) Field of Search ..... 166/343, 339, 166/345, 359, 340, 344, 338; 175/7

(56) References Cited

U.S. PATENT DOCUMENTS

| | | | | |
|---|---|---|---|---|
| 3,486,555 A | | 12/1969 | Vincent | 166/5 |
| 3,603,409 A | | 9/1971 | Watkins | 175/7 |
| 3,638,721 A | | 2/1972 | Harrison | 166/351 |
| 3,825,065 A | | 7/1974 | Lloyd et al. | 166/351 |
| 4,063,602 A | | 12/1977 | Howell et al. | 175/7 |
| 4,139,059 A | | 2/1979 | Carmichael | 166/208 |
| 4,147,221 A | | 4/1979 | Ilfrey et al. | 175/7 |
| 4,149,603 A | | 4/1979 | Arnold | 175/7 |
| 4,291,772 A | | 9/1981 | Beynet | 175/5 |
| 4,813,495 A | | 3/1989 | Leach | 175/6 |
| 5,127,478 A | * | 7/1992 | Miller | 166/348 |
| 5,273,117 A | | 12/1993 | Reimert | 166/348 |
| 5,655,603 A | * | 8/1997 | Schulte et al. | 166/368 |

OTHER PUBLICATIONS

Goldsmith, Riley, "Mudlift Drilling System Operations," Offshore Technology Conference, *OTC Proceedings*, 8751:1–15 (1998).

Kempton, R. and Hart, B., "Development of New–Generation, High–Pressure Marine Wellhead," *Society of Petroleum Engineers of AIME*, SPE 11896/1 (1983).

McLeod, Wilfred R., "A Review of Riserless Drilling Alternatives," *Society of Petroleum Engineers of AIME*, SPE 5768:1–16 (1976).

* cited by examiner

*Primary Examiner*—David Bagnell
*Assistant Examiner*—John Kreck
(74) *Attorney, Agent, or Firm*—Howrey Simon Arnold & White, LLP

(57) ABSTRACT

A deep ocean drilling system is disclosed for drilling offshore wells in extremely deep water using smaller and more economical drilling vessels. The system utilizes a reduced diameter drilling riser that reduces the size and cost of conventional floating drilling unit. The reduced diameter drilling riser is detached from the blowout preventer stack and repositioned and attached to a mud return assembly. Large diameter casing is lowered into the wellbore outside of the reduced diameter riser. Thereafter, the reduced diameter drilling riser is released from the mud return assembly and repositioned over and reconnected to the blowout preventer stack.

59 Claims, 27 Drawing Sheets

DEEP OCEAN RISER POSITIONING SYSTEM AND METHOD OF RUNNING CASING

BACKGROUND OF THE INVENTION

This invention relates to methods and systems capable of efficiently drilling offshore wells in extremely deep water using a smaller, more economical floating vessel, along with smaller, and less expensive, drilling equipment (such as hoisting equipment, riser tensioners, mud systems, etc.) than heretofore possible. This is possible because the system is able to perform all requisite tasks and functions using a reduced diameter marine riser that dramatically reduces variable deck load and space requirements for the vessel.

In recent years, the search for oil and gas deposits has taken oil companies into ever deeper offshore waters. Floating rigs of only a few years ago were generally limited to perhaps 1,500 feet of water depth, but it is now commonplace to conduct offshore drilling operations in water depths up to 5,000 feet, and several rigs are under construction which are theoretically capable of conducting drilling operations in 10,000 feet of water or more. For extreme water depths, dynamic positioning, which is not sensitive to water depth, is commonly used for vessel station keeping.

The basic deep water drilling system is unchanged from that designed more than twenty years ago. The system employed to actually drill a well in deep water is basically an extension of that for drilling in shallower water. Typically, this system employs subsea components consisting of an 18¾" subsea blowout preventer (BOP) stack installed at the ocean floor and coupled to a floating drilling rig at the ocean surface by a 21" diameter marine riser system. This arrangement allows the driller to utilize the riser to convey to, and install, the typical 18¾" API subsea BOP stack on the wellhead, and supports a well program typically including 30", 20", 13⅜", 9⅝", and 7" casing. Occasionally, additional strings of casing and/or liner may be employed.

The major adaptation of the riser system for deeper water has been to lengthen it. Lengthening the riser requires greater material strength, thicker walls, additional and larger service lines, more exotic riser connectors and tensioner system, and thicker and denser floatation. Unfortunately, lengthening the marine riser gives rise to significant consequential rig related issues as well, which, as will be shortly disclosed, tend to dominate deep water rig design, particularly semisubmersible rig design.

All marine risers must be maintained in tension whenever they are deployed; the minimum tension requirement is that the riser not be in compression at the top of the subsea BOPs. The weight of riser which the tensioning system must support is comprised of two main elements. The first is the steel weight of the riser tubing, joining connectors, auxiliary conduits, and control lines. Syntactic foam buoyancy modules are strapped around the riser to compensate for part of the riser steel weight when the riser is in the water, but these modules add to the weight in air and increase the overall diameter of the riser to around 56". By way of example, the weight in air of 10,000 feet of a 21" marine riser with buoyancy modules is approximately 3,600 tons.

In addition to the steel weight, the tensioning system must provide sufficient axial tension at the top of the riser to control the stresses and displacement of the riser while the floating drilling vessel moves horizontally and vertically in response to wind, waves and current. The tension requirements increase with increasing drilling mud weights and riser offsets. This means that even after considering the buoyancy, the riser tensioners for 10,000 feet of water have a total tensioning capacity of about 1,550 tons. In addition, while the actual drilling operation only requires about 500 tons of hoisting capacity, this must be increased to 750 to 1,000 tons to handle the riser and BOPs in deep water.

The riser required for 1,500 feet of water weighed only about 150 tons in air, did not normally require much buoyancy, and could be stowed in about 1,200 square feet of deck space. The marine riser for 10,000 feet of water weighs about 3,600 tons in air and requires a storage area of about 10,500 square feet.

The marine riser is subjected to lateral forces due to ocean currents, and these forces are proportional to the riser diameter. The lateral forces are transmitted to the vessel at the surface, and ultimately must be resisted by the vessel's station keeping system. Current flow around the riser also results in vortices, which, when shed, "pluck" the riser and induce low frequency oscillations in the riser, causing stress and fatigue. The riser for 1,500 feet of water had an effective diameter of about 36", while that for 10,000 feet of water has an effective diameter of about 56" due mainly to the use of syntactic foam buoyancy modules. Consequently, a deep water riser is subjected to greater lateral forces and stresses than a riser designed for use in shallower water.

It is sometimes required to disconnect the riser from the blowout preventers during the course of a well to effect repairs to subsea components, or in an emergency occasioned by a station keeping failure. Prior to any planned riser disconnect, the mud in the riser is displaced with seawater with the mud being returned to the mud pits on the vessel. The mud to be displaced, and stored on the vessel, that is contained in the marine riser in 1,500 feet of water, is about 600 bbls and weighs about 200 tons. Conversely, 10,000 feet of riser contains about 3,600 bbls of mud weighing nearly 1,200 tons.

In deeper sections of an offshore well where the hole-drilling diameter is small, the rate of mud circulated through the bit is reduced proportionately. For these sections, the annular velocity of the mud returns in the 21" marine riser is quite low, and while this is not much of a problem with shorter risers, in deeper water it is insufficient in the riser to carry drilled cutting solids to the surface, and an additional mud pump is required to circulate or "boost" the marine riser.

The overall cost of a deep water drilling unit is proportional to its displacement size, variable load requirements, and equipment capacity. By way of example, a conventional design for a shallow water drilling unit and a deep water drilling unit may have the following capabilities and costs:

| ITEM | 1,500' WATER | 10,000' WATER |
|---|---|---|
| Vessel Variable Deck Load | 2000 tons | 10,000 tons |
| Hoisting Capacity | 500 tons | 1000 tons |
| Mud Pit Capacity | 1500 bbls | 5000 bbls |
| Mud Pump Capacity | 3000 hp | 6000 hp |
| Free Deck Space Required | 7500 sq. ft. | 17,500 sq. ft. |
| Hull Steel Weight | 10,000 LT | 16,000 LT |
| Total Building Cost | $180 million | $350 million |

The increased size and cost of a deep water drilling unit are directly related to the increased length of the riser. It is postulated that the size and cost of a deep water rig will, within certain limits, be approximately proportional to the square of the riser diameter, and that if the riser diameter could be reduced to about ⅔ of its present diameter, the size and cost of a rig might be reduced by 40 percent or more.

The present invention is directed to a fully capable and functional drilling system capable of drilling, and/or, working over wells presently requiring the use of a 21" marine riser while utilizing a reduced diameter riser. By way of example, the present invention may use a riser having a nominal diameter of about 15". Consequently, use of the present invention will reduce the variable deck load, space requirements, hoisting, mud pit and pump capacities and, hence, the cost of a deep water floating drilling vessel.

SUMMARY OF THE INVENTION

The present invention is directed to a deep ocean drilling system for drilling an offshore well in deep water using a reduced diameter drilling riser. The reduced diameter drilling riser extends from a floating drilling vessel, such as a drill ship or a semisubmersible drilling rig, to a lower marine riser package. The lower marine riser package includes a lower marine riser package connector, a riser flex joint and possibly an annular blowout preventer. The drilling system also comprises a retrievable high pressure blowout preventer stack attached to a high pressure wellhead housing. The blowout preventer stack usually includes one or more annular preventers, one or more ram preventers, and a lower marine riser package mandrel, whereby the lower marine riser package connector may be releasably connected to the blowout preventer stack. A fluid diverter line extends from the blowout preventer stack to a fluid return mandrel, whereby the lower marine riser package connector may be releasably connected to the fluid return mandrel. Thus, the fluid return mandrel serves as an alternative, or secondary, riser support station on the blowout preventer stack. The drilling system also includes a retrievable lifting and guide frame assembly comprising an upper lifting frame and a lower guide frame. The lifting frame is connected to the lower marine riser package connector. The lower marine riser package connector and the upper lifting frame are vertically and laterally moveable within a slot formed in the lower guide frame to maintain the axial alignment of the riser and provide a pathway for controlled movement of the riser between the lower marine package mandrel and the fluid return mandrel.

The drilling system further comprises choke and kill lines, hydraulic power and control lines extending from the drilling vessel and releasably connected to the blowout preventer stack, wherein such lines remain functional and protected from mechanical damage when the lower marine riser package connector is disconnected from the lower marine riser mandrel and reconnected to the mud return mandrel. Likewise, the choke and kill lines, hydraulic power and control lines remain functional and protected from mechanical damage when the lower marine riser package is disconnected from the mud return mandrel and reconnected to the lower marine riser mandrel.

In another embodiment of the present invention, the blowout preventer stack, diverter line and fluid return mandrel are self-contained within a support frame. The lower guide frame may be releasably connected to the blowout preventer support frame. The choke and kill lines, hydraulic power and control lines are also releasably connected to the blowout preventer stack. The blowout preventer stack and the lower marine riser package each contain receptacles for the control pod and choke and kill lines.

The mud diverter line of another embodiment of the present invention includes a riser dump valve to allow well flow to be diverted to the sea at the wellhead, or to dump heavy mud from the riser without disconnecting the riser from the blowout preventer stack. The riser dump valve also allows the well to fill with seawater. The mud diverter line provides a means to independently circulate the well and the marine riser and to displace either to sea water or other fluid, such as drilling mud, while the riser is connected to the secondary riser support station. The blowout preventer stack may further include a rotating head for sealing about the drill string when the riser is connected to the fluid return mandrel. Such an arrangement would permit drilling while the riser is connected to the mud return mandrel whereby mud circulated to the drilling bit would be diverted to the riser and returned to the drilling vessel.

In another embodiment of the invention, fairings are included on all riser connection flanges and the lower marine riser package to deflect equipment being lowered in open water away from the riser to minimize or eliminate damage resulting from possible collisions.

In another embodiment of the invention, a deep ocean drilling system for drilling offshore wells from a drilling vessel includes a lifting and guide frame assembly comprising an upper lifting frame connected to the lower marine riser package connector and a lower guide frame connected to the blowout preventer stack, wherein the lifting frame restricts the vertical movement of the lower marine riser package connector and the guide frame restricts the lateral movement of the lower marine riser package connector to maintain the axial alignment of the riser and control the movement of the riser between the lower marine riser package mandrel and the secondary support mandrel. The deep ocean drilling system may comprise a guide funnel attached to the lifting frame and positioned directly above the blowout preventer stack when the lower marine riser package connector is connected to the secondary support mandrel.

In another aspect of the invention, a riser system for connecting a subsea blowout preventer stack to an offshore drilling vessel is provided which comprises a riser pipe extending from the drilling vessel to a lower marine riser package connector; a blowout preventer stack having a lower marine riser package mandrel wherein the lower marine riser package connector may be releasably connected to the lower marine riser package mandrel; a secondary support mandrel wherein the lower marine riser package connector may be releasably connected to the secondary support mandrel; and a guide frame assembly comprising a guide frame attached to the blowout preventer stack, a guide pin attached to the lower marine riser package connector, the guide pin retained within a slot formed in the guide plate, the guide plate being attached to the guide frame by one or more pivotable arms wherein the slot in the guide plate restricts the vertical movement of the lower marine riser package connector relative to the blowout preventer stack and the arms restrict the lateral movement of the lower marine riser package connector between the lower marine riser package mandrel and the secondary support mandrel to maintain the axial alignment of the riser during movement of the riser between the lower marine riser package mandrel and the secondary support mandrel. The guide frame assembly may comprise a hydraulic actuating arm attached to the guide frame at one end and attached to the arms wherein the ram can be actuated to laterally move the lower marine riser package connector from the lower marine riser package mandrel to the secondary support mandrel, or vice versa.

In another aspect of the invention, a subsea wellhead system is provided comprising a wellhead housing having an internal bore with a landing means in the bore, a casing hanger having an external shoulder for landing on the landing means of the wellhead housing, wherein the casing hanger has an internal bore with an internal landing means for supporting subsequent casing strings. By way of example, the subsea wellhead system may comprise a 18¾" wellhead housing and a 13⅜" casing hanger with an internal bore configured with an internal landing means for supporting subsequent casing strings. The subsequent casing strings may include a 9⅝" casing string with a 9⅝" casing hanger and a 7" casing string with a 7" casing hanger and a suitable tubing hanger.

The present invention also pertains to a method of drilling a well in deep water from a floating drilling vessel having a reduced diameter riser for connecting the vessel to the well. The method comprises the steps of providing a lower marine riser package on the end of the reduced diameter riser to connect the riser to a lower marine riser mandrel on a high pressure blowout preventer stack, disconnecting the lower marine riser package connector on the lower marine riser package from the lower marine riser mandrel, repositioning the riser over a secondary riser support mandrel on the blowout preventer stack, connecting the lower marine riser package connector to the secondary riser support mandrel, wherein a fluid diverter line provides fluid communication between the secondary support mandrel and the blowout preventer stack, and lowering a 13⅜" casing string outside of the riser through the blowout preventer stack and into the well while the well is in fluid communication with the riser. The method further comprises installing an automatic casing fill-up float shoe on the casing to minimize casing float and, thus, buckling forces due to a lack of lateral support of the casing string from the marine riser. Alternatively, the 13⅜" casing string may be run open ended without float equipment to minimize casing float and buckling forces.

The method may further comprise the step of using active motion compensation to affect disconnection, reconnection, and stabbing operations. An auxiliary hoist may be used to lower the 13⅜" casing to the blowout preventer stack and into the well.

The method of the present invention may include stripping a 13⅜" casing string through the blowout preventer stack while taking returns through the riser as the casing string is lowered into the well.

The method may further comprise providing the 13⅜" casing string with a 13⅜" casing hanger and landing the hanger in a subsea wellhead housing, the casing hanger having an internal bore with a landing means for landing a subsequent casing hanger on a casing string, whereby the subsequent casing hanger and casing string may pass through the reduced diameter riser. The method may further comprise running a second string of casing through the reduced diameter riser and landing its casing hanger in the bore of the 13⅜" casing hanger.

Another embodiment of the present invention is directed to a method of running casing from an offshore vessel to a subsea wellhead comprising the steps of providing a lower marine riser package connector on the end of the reduced diameter riser to connect the riser to a lower marine riser mandrel on a blowout preventer stack; disconnecting the lower marine riser package connector from the lower marine riser mandrel; repositioning the riser over a secondary support mandrel on the blowout preventer stack; connecting the lower marine riser package connector to the secondary support mandrel; lowering a casing string outside the riser through the blowout preventer stack and into the well; landing a casing hanger for the casing string in a subsea wellhead housing, the casing hanger having an internal landing means in the bore of the hanger; releasing the lower marine riser package connector from the secondary support mandrel and reconnecting the lower marine riser package connector to the lower marine riser package mandrel on the blowout preventer; lowering a subsequent casing string through the riser and into the well; and landing the casing hanger for a subsequent casing string on the internal landing means of the previous hanger.

Figure 1:
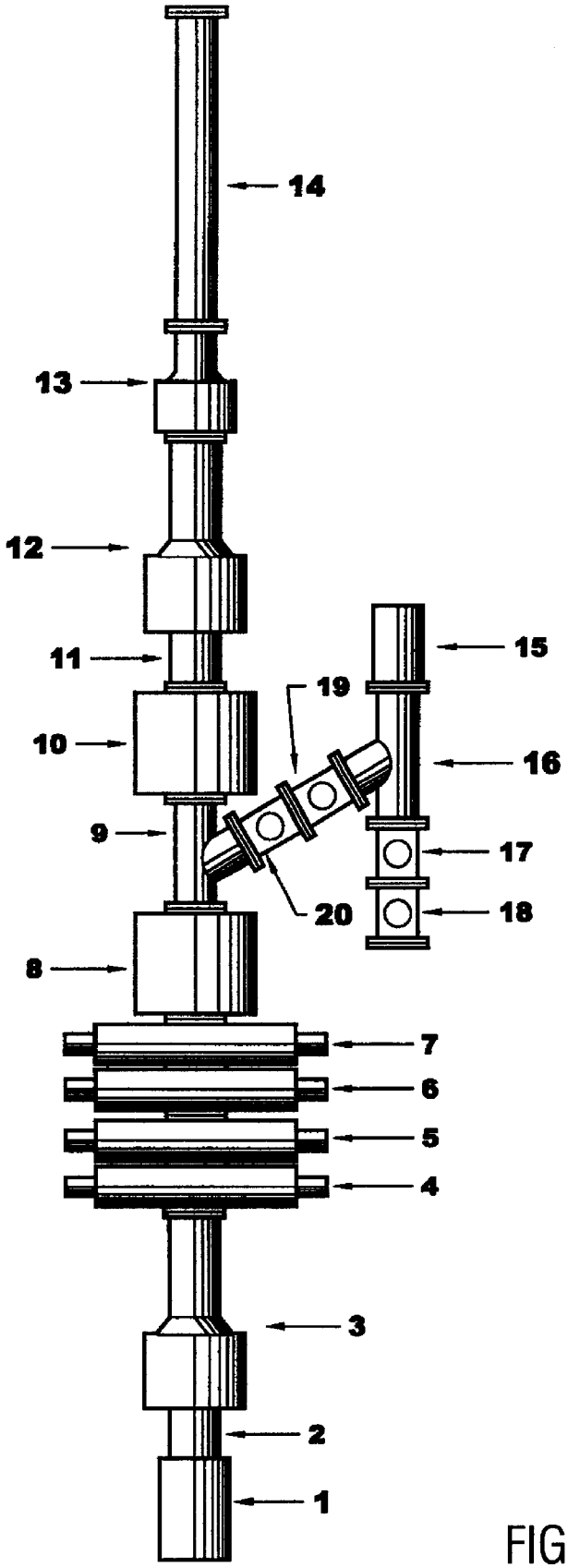
FIG. 1 illustrates the arrangement of the subsea components of the reduced diameter riser system of the present invention at the seabed.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as described by the appended claims.

DESCRIPTION OF THE PREFERRED EMBODIMENTS

While all wells are custom designed, and drilling depths and casing sizes and setting depths are adapted to the geology, one common method for drilling deep water wells is to establish the well by drilling a 36" hole, then running and cementing a 30" diameter conductor pipe which is fitted at the top with a wellhead housing. Alternatively, in soft bottom situations, the 30" conductor pipe may be jetted in place utilizing an internal drill bit/jetting assembly.

A 26" hole is next drilled through the 30" conductor and then 20" casing, fitted with an 18¾" high pressure wellhead, is run and cemented. During these operations, no marine riser is used, and all well returns and cuttings are simply allowed to be circulated to the sea floor. For deep water drilling vessels, the 18¾" wellhead is typically rated for 10,000 psi or 15,000 psi service.

An 18¾" high pressure BOP stack is next run to the wellhead on the 21" marine riser, and latched onto the wellhead. All subsequent drilling operations will be conducted through the marine riser and BOPs, with mud returning to the surface vessel via the marine riser. The 18¾" BOP stack is typically rated for 10,000 psi or 15,000 psi service.

A 17½" hole is usually drilled next, and a string of 13⅜" casing is run and cemented in the 17½" hole section. The 17½" bit and 13⅜" casing, and all smaller sizes of each will pass through the minimum 18¾" inside diameter of the marine riser and BOP. This is followed by a 12¼" hole and 9⅝" casing, and an 8½" hole and 7" casing or liner to the well's total depth. In deep water, or in other circumstances, additional hole sections and casing and or liner strings of various sizes may be required.

The present invention will be described using the same well program as described above. However, one of skill in the art will recognize that the present invention can be adapted for use with other well programs as well as other drilling, completion or workover operations.

The arrangement of the components at the seabed according to one embodiment of the present invention is shown in FIG. 1 and consists of an 18¾" wellhead mandrel and housing 2 installed in a 30" wellhead housing 1. Connected to the 18¾" wellhead mandrel 2 is an 18¾" blowout preventer stack comprising a wellhead connector 3, lower ram blowout preventer 4, lower middle ram blowout preventer 5, upper middle ram blowout preventer 6, upper ram blowout preventer 7, lower annular blowout preventer 8, blowout preventer stack flowline diverter spool 9, upper annular blowout preventer 10, and 18¾" lower marine riser package connector mandrel 11. Connected to the BOP stack is an 18¾" lower marine riser package connector 12, and 18¾" lower flex joint 13. The blowout preventer stack is a high pressure BOP stack, typically rated to 10,000 or 15,000 psi. Connected to the 18¾" blowout preventer stack flowline diverter spool 9 is a fluid diverter line which may comprise an inner riser isolation valve 20, outer riser isolation valve 19, riser base flowline diverter spool 16, inner riser dump valve 17, outer riser dump valve 18, and 18¾" mud return mandrel 15.

A reduced diameter drilling riser 14 connects these components to the drilling vessel 22 at the surface of the sea. The drilling riser is comprised of riser joints which may be connected by conventional riser connectors. The riser also includes choke and kill lines as well as control and service lines (not shown) for the subsea BOP stack 28, lower marine riser package 27 and mud return assembly 26 shown on FIG. 2. A reduced diameter riser is defined to mean a riser having a drift diameter smaller than 17½". Preferably, the reduced diameter riser has a drift diameter equal to or less than the coupling diameter of a standard API 13⅜" casing. In the preferred embodiment, the reduced diameter drilling riser has a 15" nominal outside diameter and a 14" internal diameter or drift diameter.

Figure 2:
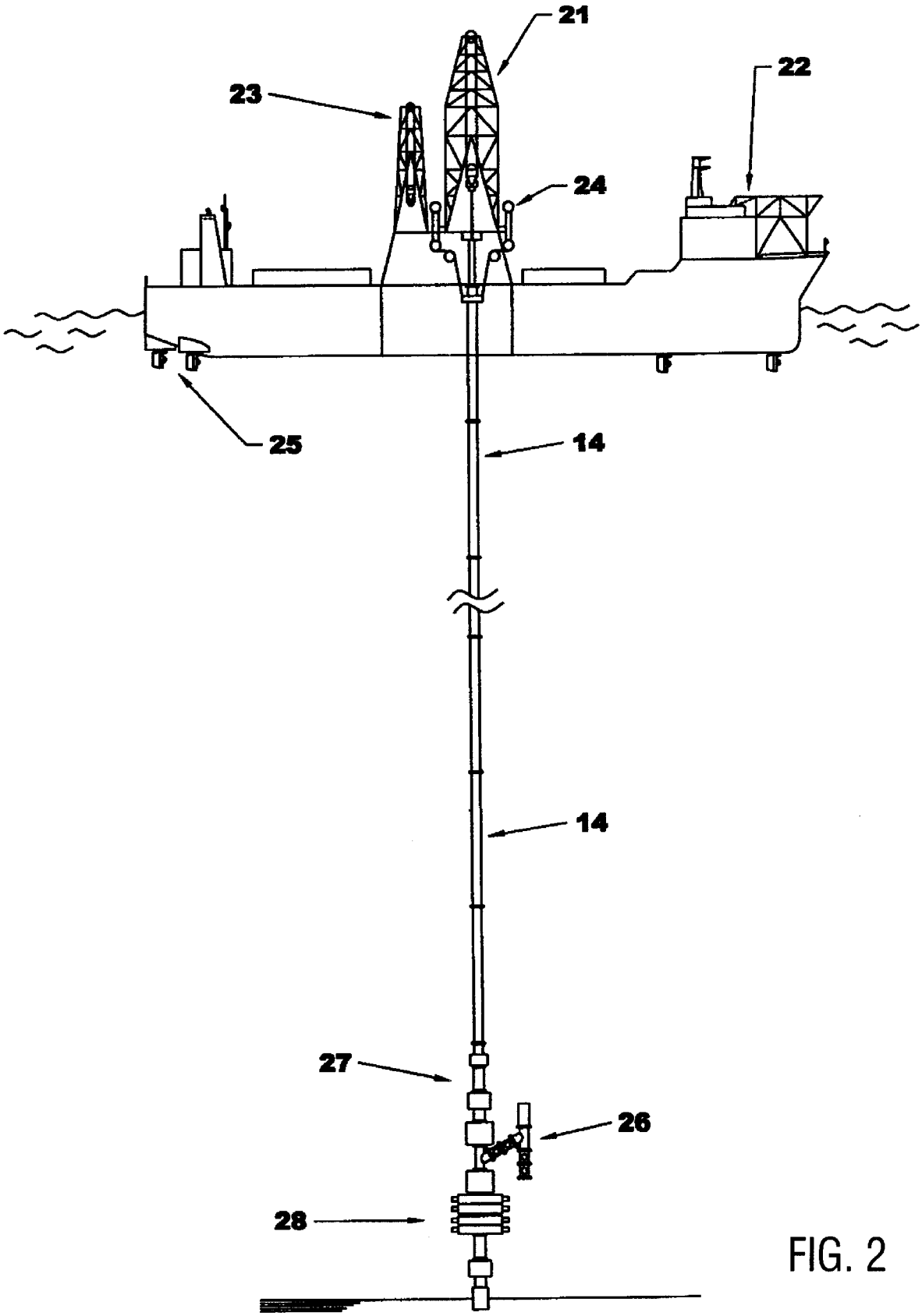
FIG. 2 is an elevational view showing a deep water drilling vessel and a riser system of the present invention.

FIG. 2 shows the overall arrangement of one embodiment of a deep water drilling system according to the present invention. The support structure around the blowout preventer 28 is not shown for clarity. Drilling vessel 22 includes main hoist 21, auxiliary hoist 23, and riser tensioners 24. Thrusters 25 maintain drilling vessel 22 above the well to be drilled. Alternatively, mooring lines and anchors can be used to maintain station above the well. Drilling riser 14 is supported by riser tensioners 24 on drilling vessel 22. Tensioners 24 maintain the riser in tension when the riser is connected to the well. The components on the seabed comprise a lower marine riser package 27 which as previously shown in FIG. 1 includes lower marine riser package connector 12 and lower flex joint 13; a mud return assembly 26 consisting of the inner riser isolation valve 20, outer riser isolation valve 19, riser base flowline diverter spool 16, inner riser dump valve 17, outer riser dump valve 18, and mud return mandrel 15; and an 18¾" blowout preventer stack 28 consisting of blowout preventer stack wellhead connector 3, lower ram blowout preventer 4, lower middle ram blowout preventer 5, upper middle ram blowout preventer 6, upper ram blowout preventer 7, lower annular blowout preventer 8, blowout preventer stack flowline diverter spool 9, upper annular blowout preventer 10, and lower marine riser package connector mandrel 11.

Figure 3:
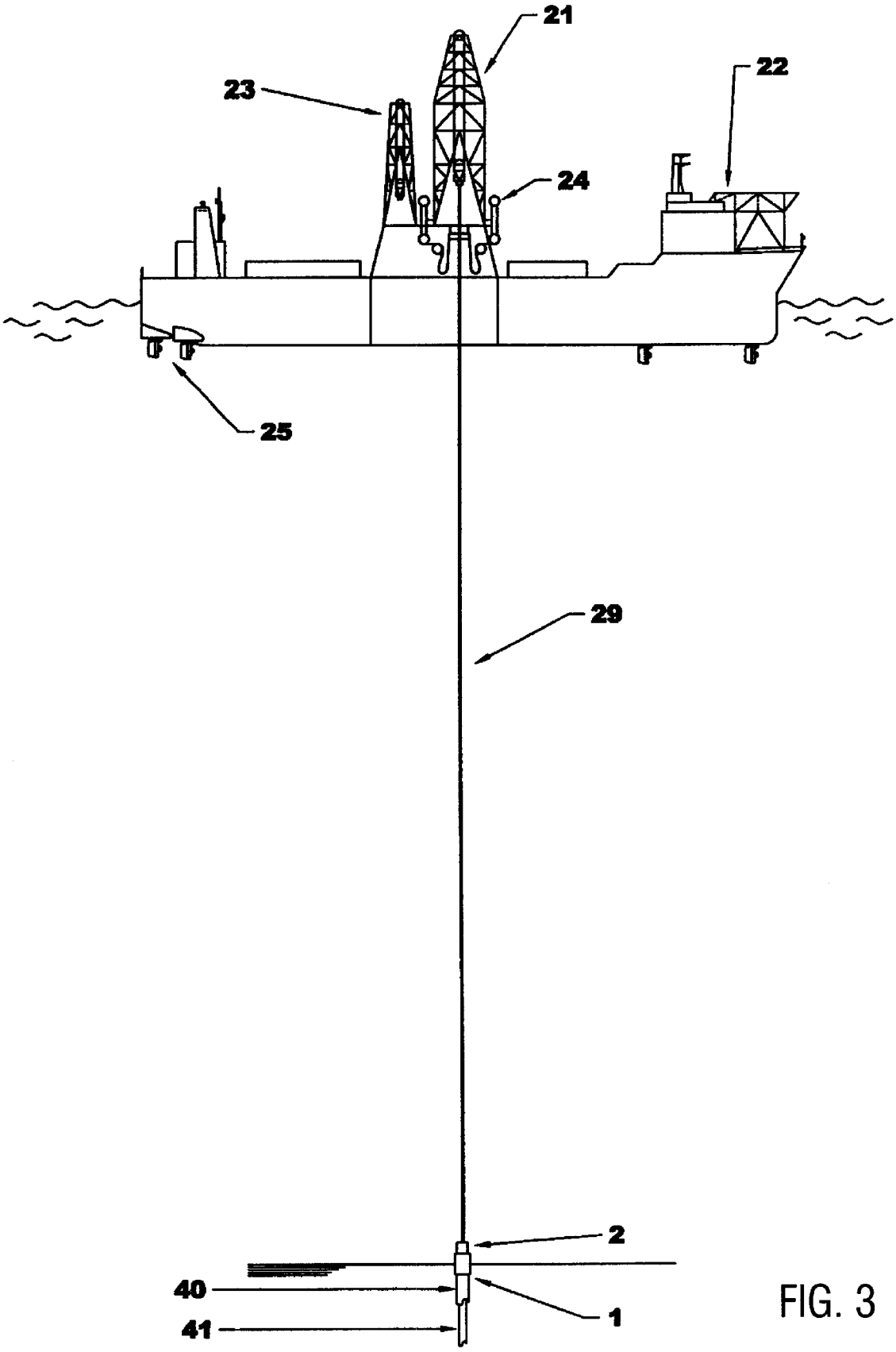
FIG. 3 is an elevational view of the initial stages of drilling a subsea well.

During the initial stages of drilling a well with the present invention, all operations are carried out in a conventional manner as indicated in FIG. 3. Drilling vessel 22 establishes the well by either drilling a 36" hole for, or jetting into place, the 30" conductor 40. The 30" wellhead housing 1 is attached to the top of the 30" conductor. Following this, a 26" hole is drilled and a string of 20" casing 41 is lowered in the wellbore (not shown). The 18¾" wellhead mandrel and housing 2 is attached to the top of the 20" casing and lands inside the 30" wellhead housing. FIG. 3 shows the 18¾" wellhead housing 2 being landed inside the 30" wellhead housing 1 with landing string 29 supported from main hoist 21. Drillpipe is typically used as the landing string.

Figure 4:
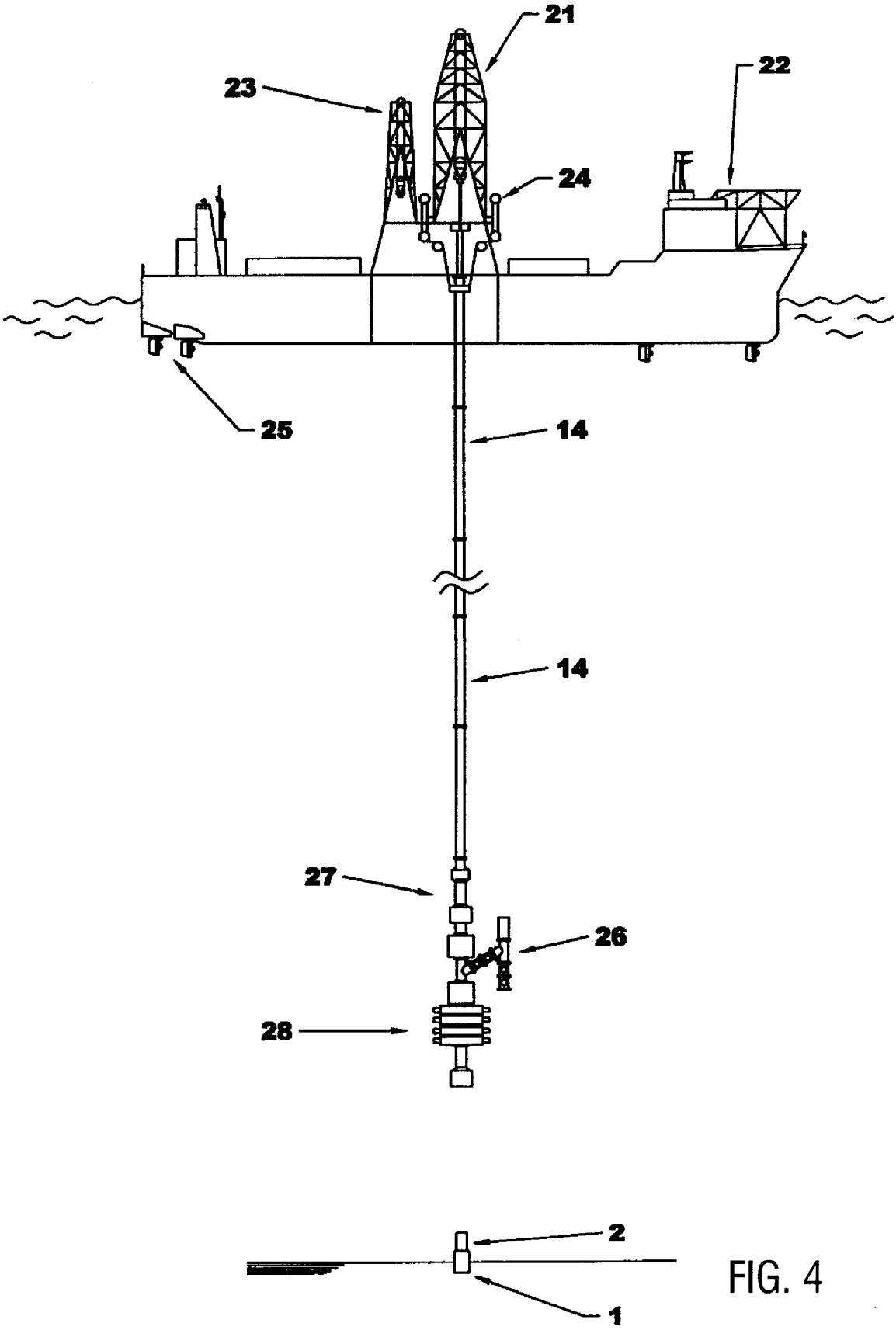
FIG. 4 is an elevational view illustrating the lowering of the mud return assembly, lower marine riser package, and blowout preventer stack to the subsea wellhead.
Figure 5:
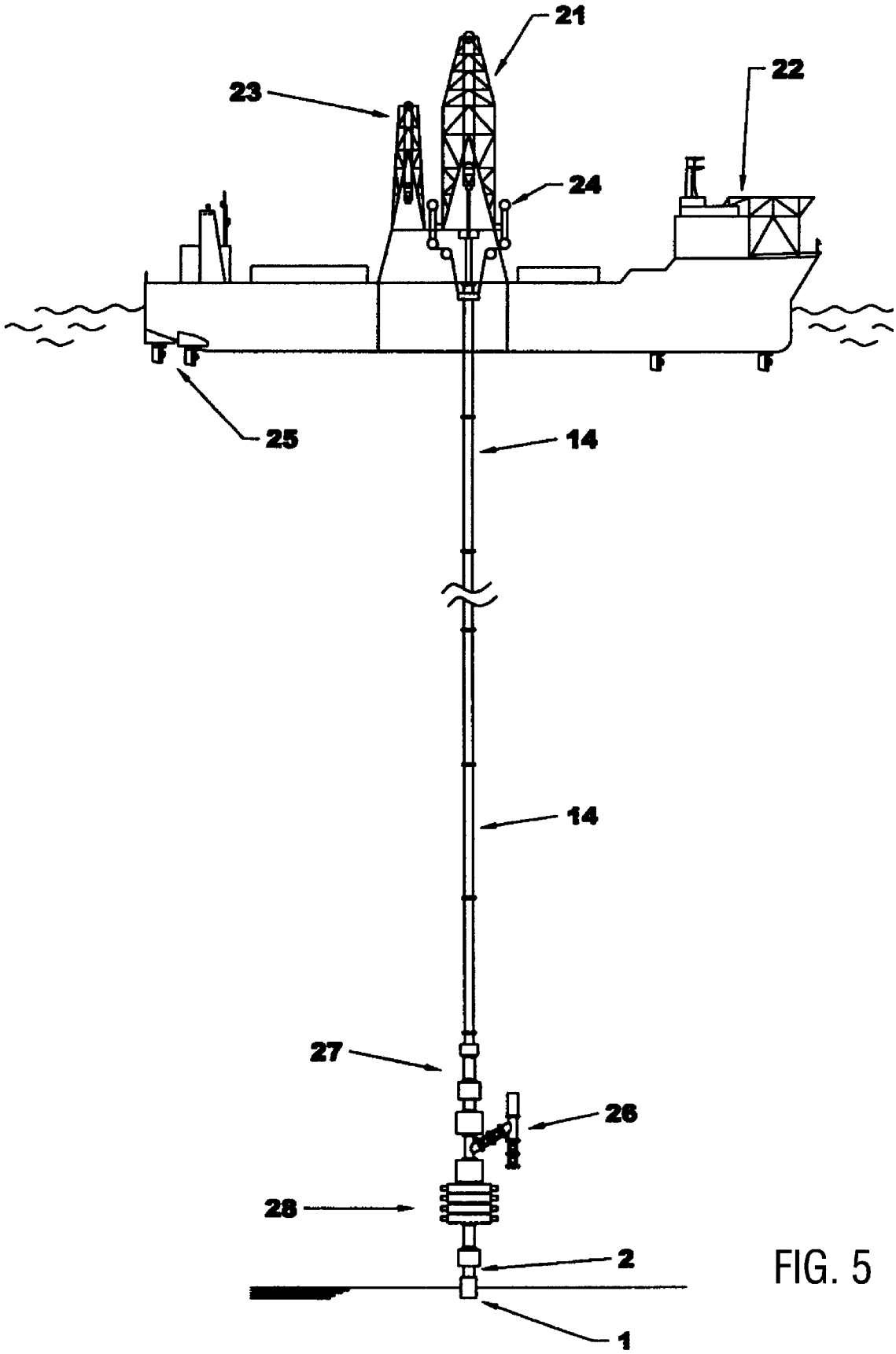
FIG. 5 is an elevational view of the mud return assembly, lower marine riser package, and blowout preventer stack landed on and latched onto the wellhead housing.

After installing the 18¾" wellhead mandrel and housing 2, the mud return assembly 26, lower marine riser package 27 and blowout preventer stack 28 are lowered on the 15" nominal diameter drilling riser 14 as shown in FIG. 4. The mud return assembly 26, lower marine riser package 27 and blowout preventer stack 28 are landed on and latched onto 18¾" wellhead mandrel 2 as shown in FIG. 5. Drilling riser 14 is suspended from the riser tensioners 24. Since the 15" riser is too small to pass a 17½" bit, the 17½" hole section is drilled using a smaller, for example a 12¼" bit followed by a 17½" under-reaming tool. The under-reaming tool, of which several types are available and in common use, will pass through the marine riser, and follow the 12¼" bit to open the hole to 17½" in diameter.

Figure 6:
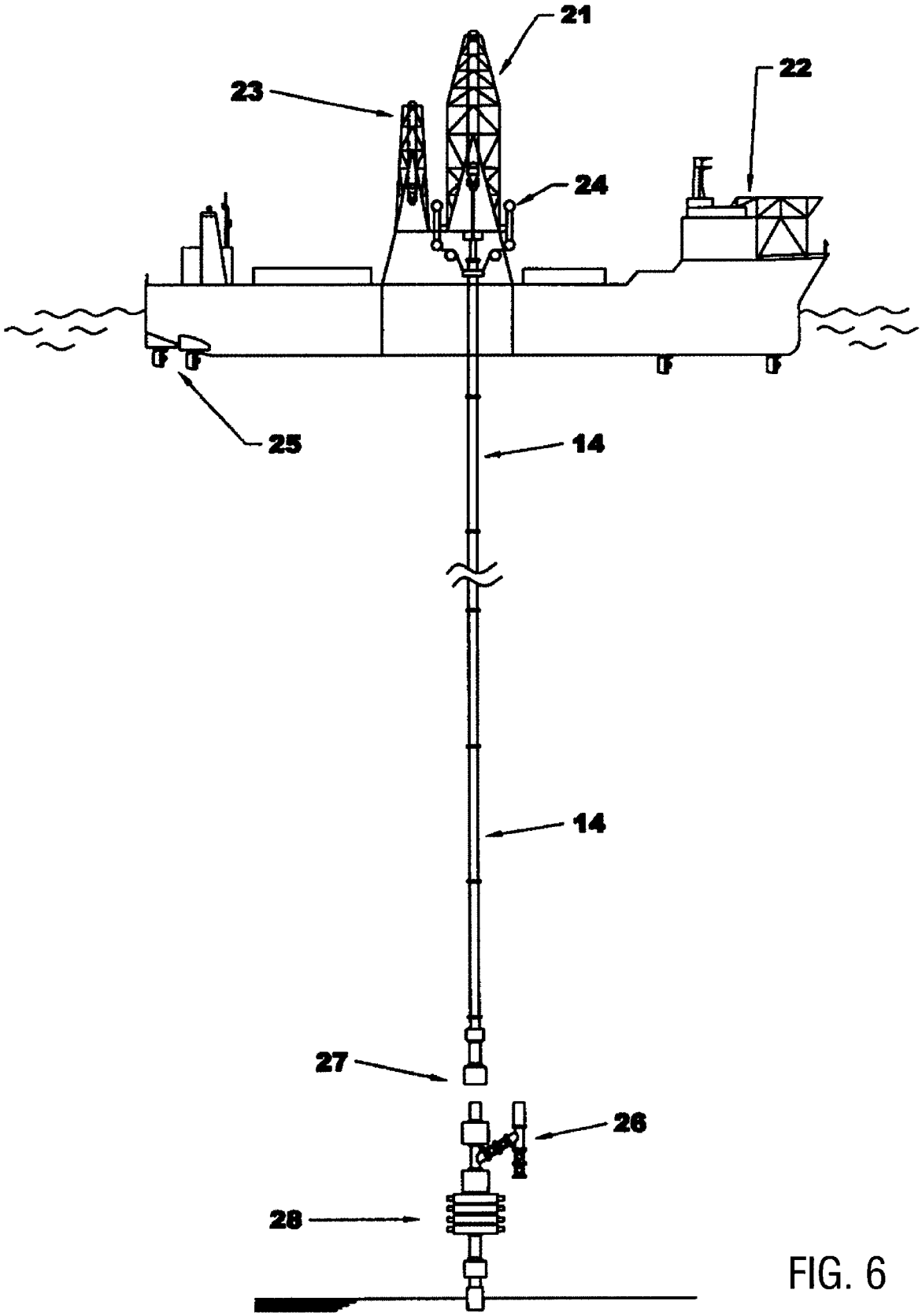
FIG. 6 is an elevational view illustrating the lower marine riser package disconnected from the blowout preventer stack.
Figure 7:
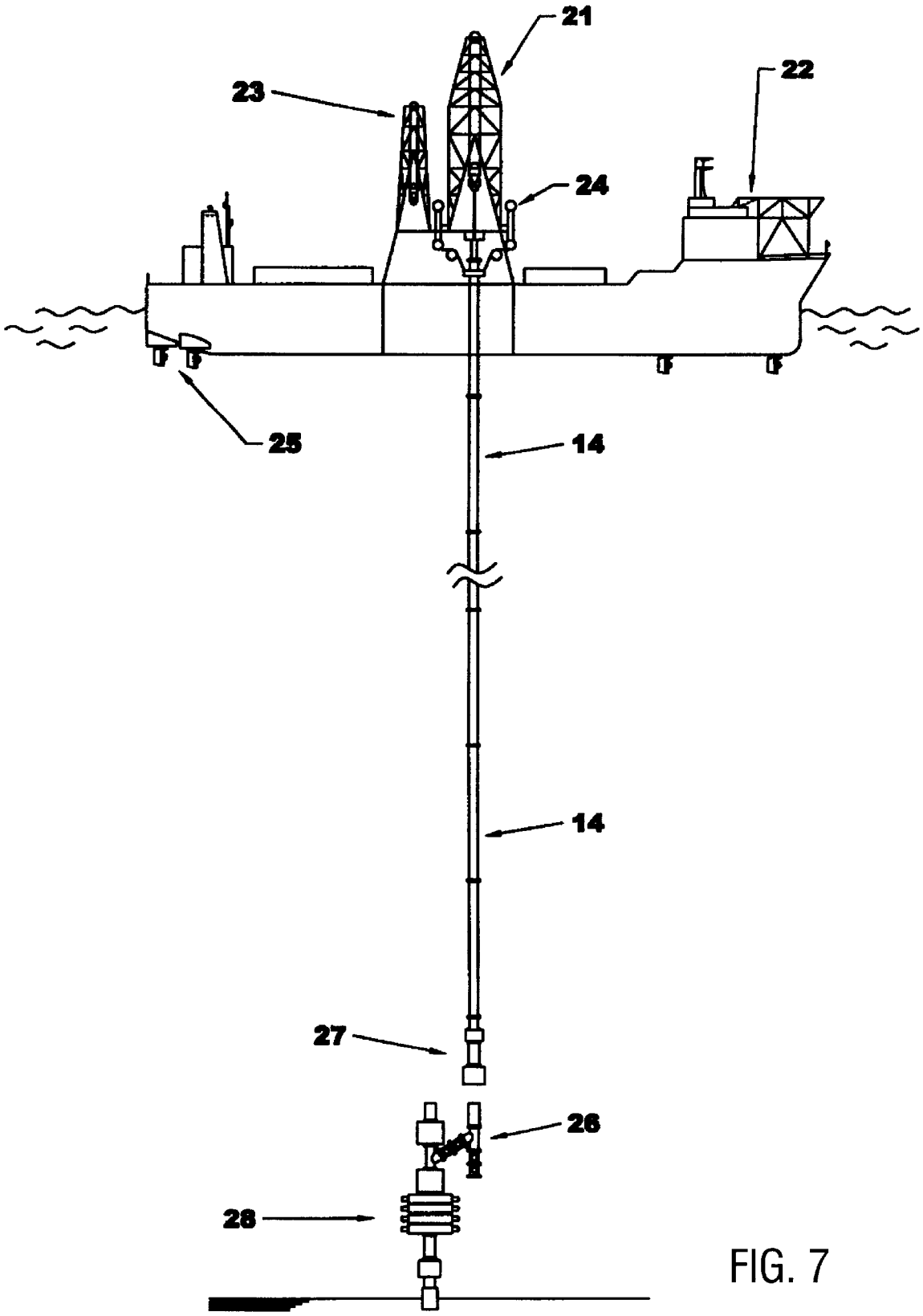
FIG. 7 is an elevational view illustrating the lower marine riser package repositioned over the mud return assembly.
Figure 8:
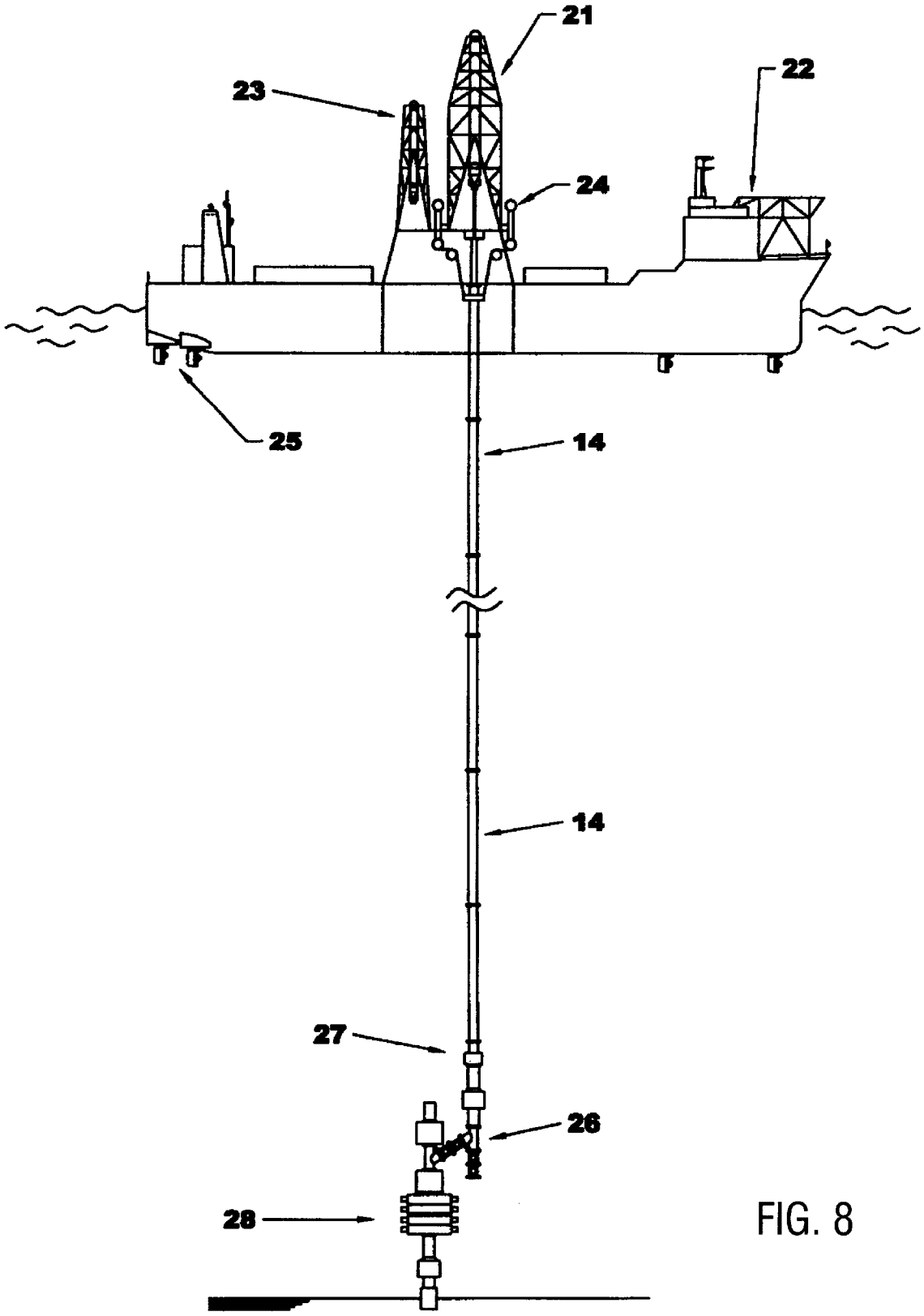
FIG. 8 is an elevational view illustrating the drilling riser and lower marine riser package attached to the mud return assembly.
Figure 10:
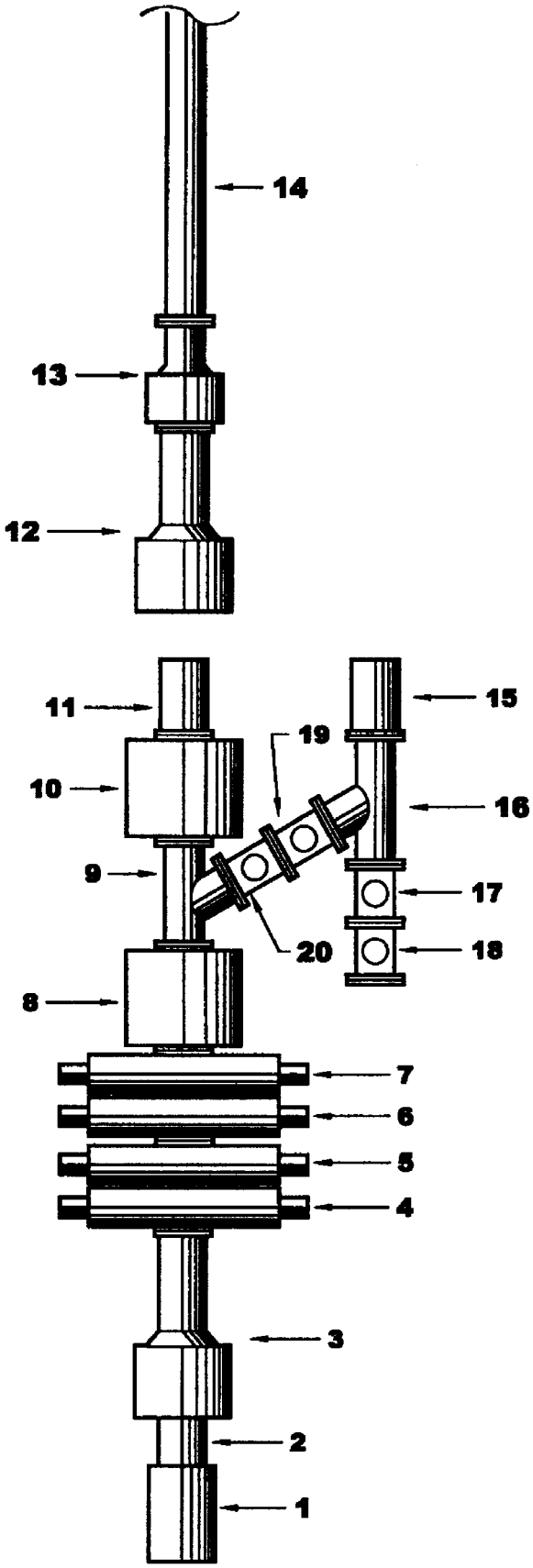
FIG. 10 is an enlarged view of the lower marine riser package disconnected from the blowout preventer stack.

The 13⅜" casing will not pass through the 15" nominal marine riser, and the casing hanger at the top of the casing has a diameter of about 18⅝", so in order to run this string of casing the marine riser must be moved out of the well path. Therefore, upon completion of drilling operations for the 17½" hole section, the well is killed with drilling mud, the BOP is closed, the drilling riser 14 is displaced to seawater and the lower marine riser package 27 is disconnected from the blowout preventer stack 28 as shown in FIGS. 6 and 10. The drilling vessel 22 repositions the drilling riser 14 and the lower marine riser package 27 over the mud return assembly 26 and the riser and lower marine riser package is lowered to and latched onto the mud return assembly 26 as shown in FIGS. 7, 8, 11 and 12. The mud return assembly 26 serves as a secondary support station for the riser when the riser is removed from the well path.

Figure 9:
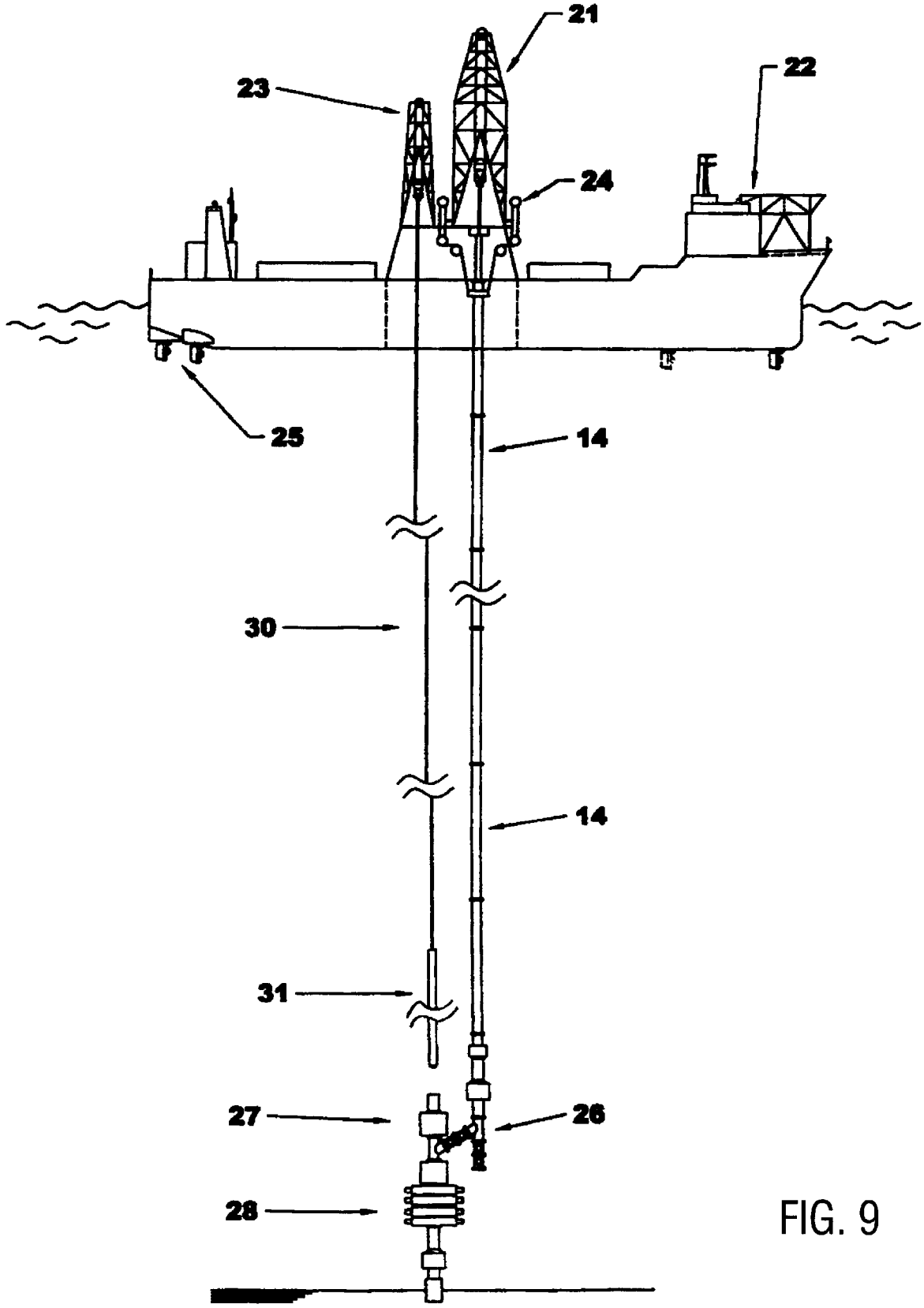
FIG. 9 is an elevation view illustrating the 13⅜" casing string being lowered into the wellbore outside of the drilling riser.
Figure 13:
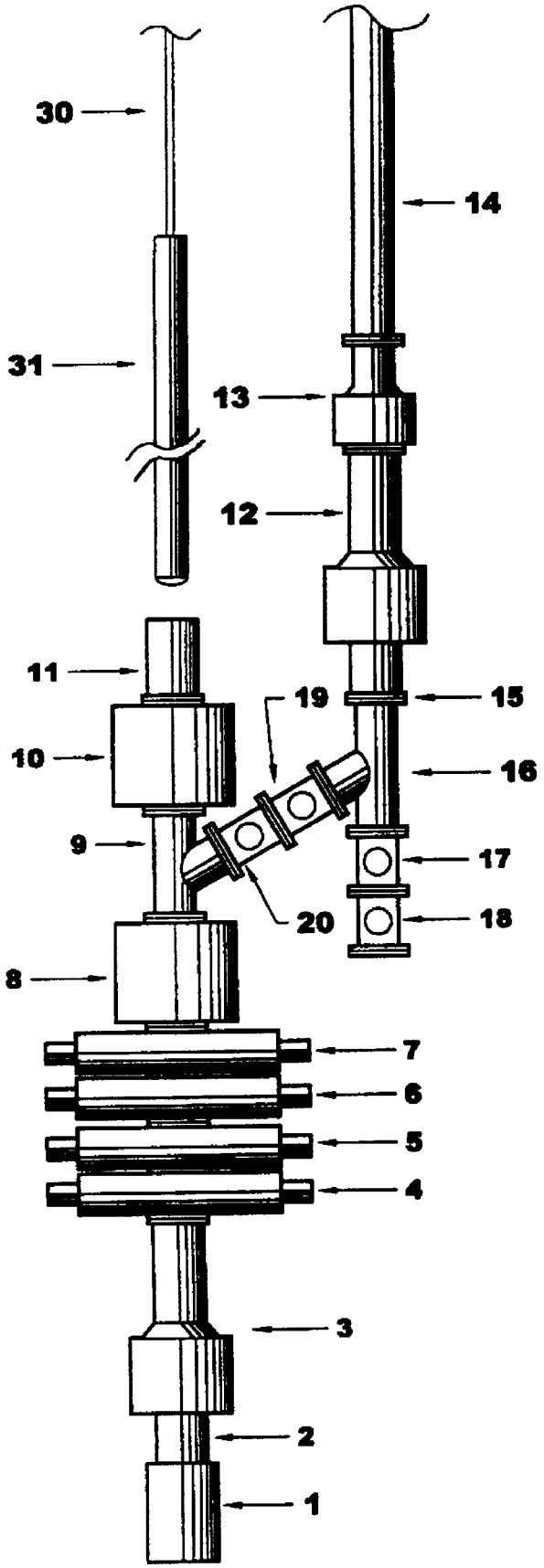
FIG. 13 is an enlarged view of the 13⅜" casing string being lowered into the wellbore outside of the riser.

The 13⅜" casing string 31 is then made up and lowered by auxiliary hoist 23 into the wellbore outside the 15" nominal diameter drilling riser on landing string 30 as shown in FIGS. 9 and 13. Alternatively, the 13⅜" casing may be assembled and lowered into the water with the auxiliary hoist while the 17½" hole section is being drilled. The 13⅜" casing string may include an automatic casing fill-up float shoe and cement wiper float collar to minimize the casing float and, thus, the buckling forces due to the casing string being laterally unsupported by the marine riser. Alternatively, the casing string may be run open ended without float equipment. In either case, the casing string will be allowed to fill with well bore mud as the casing string is lowered into the wellbore. Automatic casing float shoes and cement wiper float collars are well known in the art.

Since the 13⅜" casing string is being run in open water conditions outside of the reduced diameter riser, the upper end of the marine riser is located as far up current as possible so as to minimize the possibility of collision of the casing string with the riser. The 13⅜" casing string and the drillpipe landing string are quite flexible in deep water, and will be deflected from the vertical axis by current forces acting upon them. While the vertical velocity of the casing being run is not great, the mass is huge, and collisions with the riser should be avoided particularly while the casing is being lowered vertically in open water. Fairings may be included on all riser connection flanges in the lower marine riser package to deflect equipment being lowered in open water away from the riser to minimize or eliminate damage resulting from possible collisions. To avoid collisions between the casing string and the marine riser, it is necessary to ensure that the unsecured lower end of the casing is carried away from the riser and BOP by any current while lowering the casing through the water. Once the casing string reaches the vicinity of the blowout preventer stack, the drilling vessel can be repositioned with the thrusters, or mooring lines, to align the bottom of the casing string with the wellbore, and allow the casing string to enter the blowout preventer stack. A guide funnel may be used to facilitate entry. Cameras including those installed on a remote operating vehicle (ROV) may be used to assist the lowering of the casing string into the blowout preventer stack. ROVs, and their use, are well known in the art for subsea operations.

When the 13⅜" casing string has been landed inside the 18¾" wellhead housing 2 and cemented in place, the drilling riser 14 is again displaced to seawater and disconnected from the mud return assembly along with the lower marine riser package and returned to the original position on top of the blowout preventer stack 28 as shown in FIG. 5. Drilling operations from this point on are conducted through the 15" nominal diameter drilling riser 14 with no further need to perform the disconnection and relocation operation. This is based on using a novel wellhead design that will accommodate casing hangers of a smaller diameter than the inside diameter of the marine riser for the 9⅝" and 7" casing strings.

FIGS. 10 through 13 show the above process in more detail. In FIG. 10, drilling riser 14, lower flex joint 13 and lower marine riser package connector 12 are disconnected from the lower marine riser package connector mandrel 11 and the remainder of the blowout preventer stack.

Figure 11:
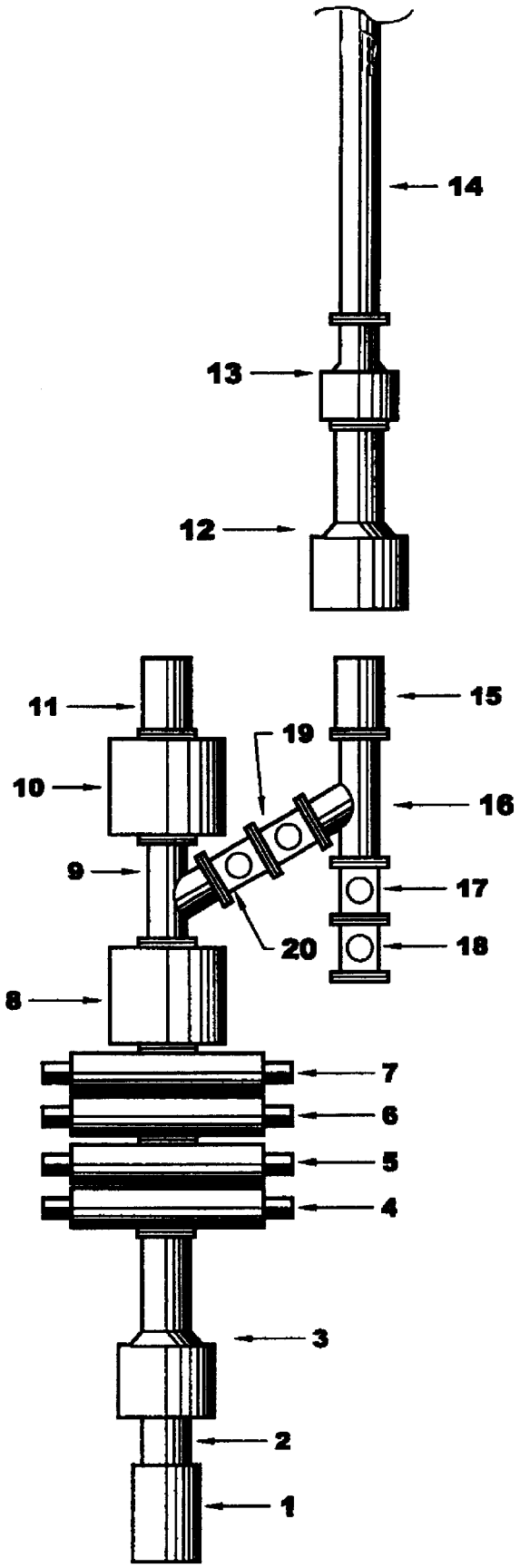
FIG. 11 is an enlarged view of the lower marine riser package positioned above the mud return assembly.
Figure 12:
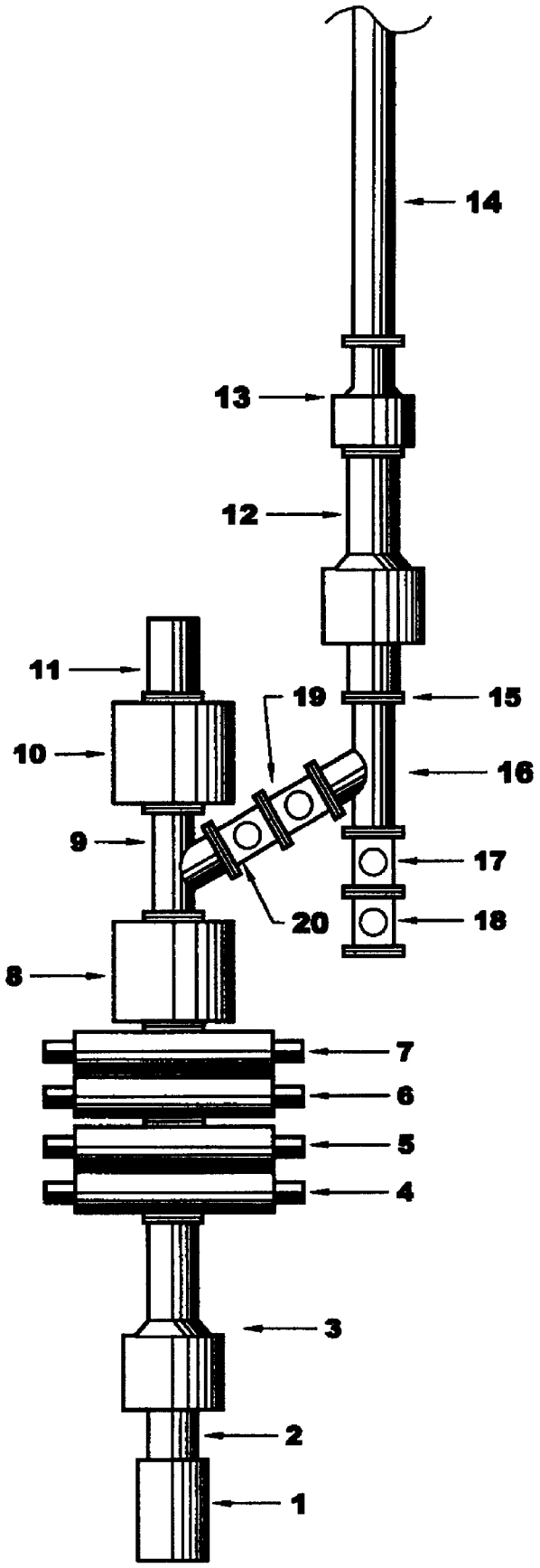
FIG. 12 is an enlarged view of the lower marine riser package connected to the mud return assembly.

In FIG. 11, drilling riser 14, lower flex joint 13 and lower marine riser package connector 12 have been moved over to a position directly above mud return mandrel 15. The drilling riser 14, lower flex joint 13 and lower marine riser package connector have been lowered onto and connected to mud return mandrel 15 in FIG. 12. FIG. 13 shows the 13⅜" casing string 31 being lowered into the wellbore through the blowout preventer stack on landing string 30.

U.S. Pat. No. 4,147,221 to Ilfrey describes a pivotable, hydraulic toggle arrangement wherein the riser connector is relocated from a primary to an alternative support. However, because the device moves the connector in a semicircular arc, the riser connector would be axially missaligned by a significant amount when the connector receptacle initially engages the mandrel. The connector will not tolerate more than a few centimeters of axial misalignment during connection or disconnection and the resulting interference would prevent the connector from mating and locking. To avoid this problem, one embodiment of the present invention includes a two piece lifting and guide frame assembly shown in FIGS. 14 through 19 which maintains the riser in axial alignment during disconnection, transport and reconnection between the mandrel 11 and mud return mandrel 15.

Figure 18A:
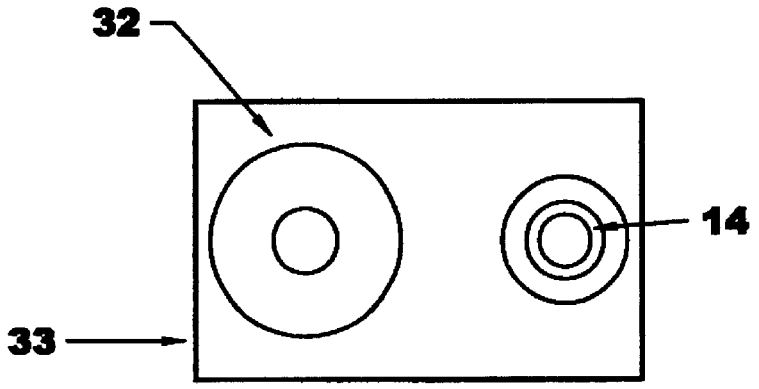
FIG. 18 is a top view of the upper lifting frame and the lower guide frame.
Figure 18B:
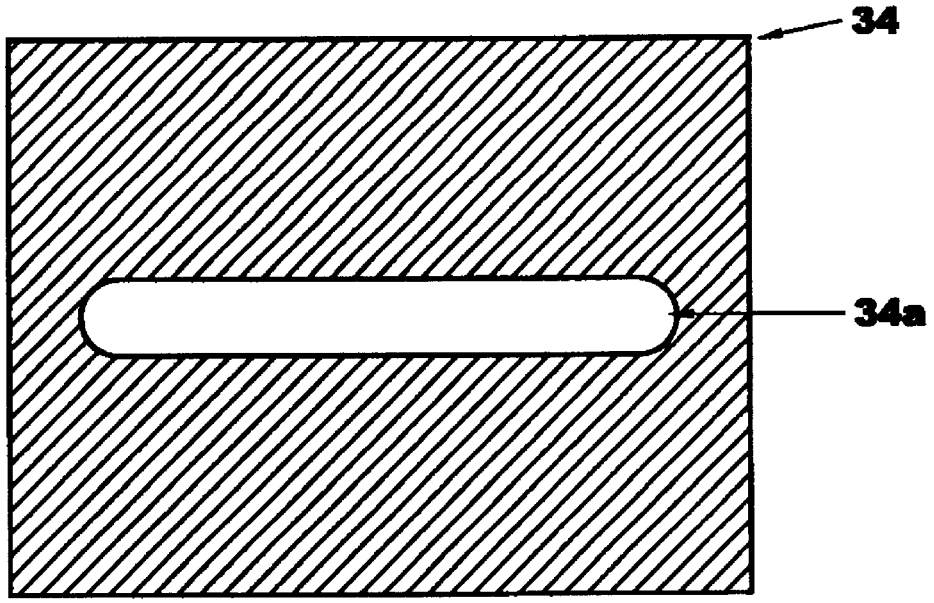

The lower flex joint 13, lower marine riser package connector 12, riser 14 and guide funnel 32 are joined together by means of upper lifting frame 33. These components can move laterally within the limits of slot 34*a* in the lower guide frame 34 as shown in FIG. 18, but are restrained from moving further than required to effect the relocation of these components. Choke and kill lines 39, BOP control lines 42 and other service lines (not shown) can remain connected to the blowout preventer stack throughout the range of movement of the lower marine riser package 27 within the lower lifting and guide frame 34. More particularly, choke and kill lines 39, pod control lines 42 and other service lines (not shown) remain connected at all times to the blowout preventer stack by means of control pod 36 and choke and kill line connectors 38 during the relocation of the lower marine riser package between the lower marine riser package mandrel 11 and the mud return mandrel 15, or vice versa.

Figure 15:
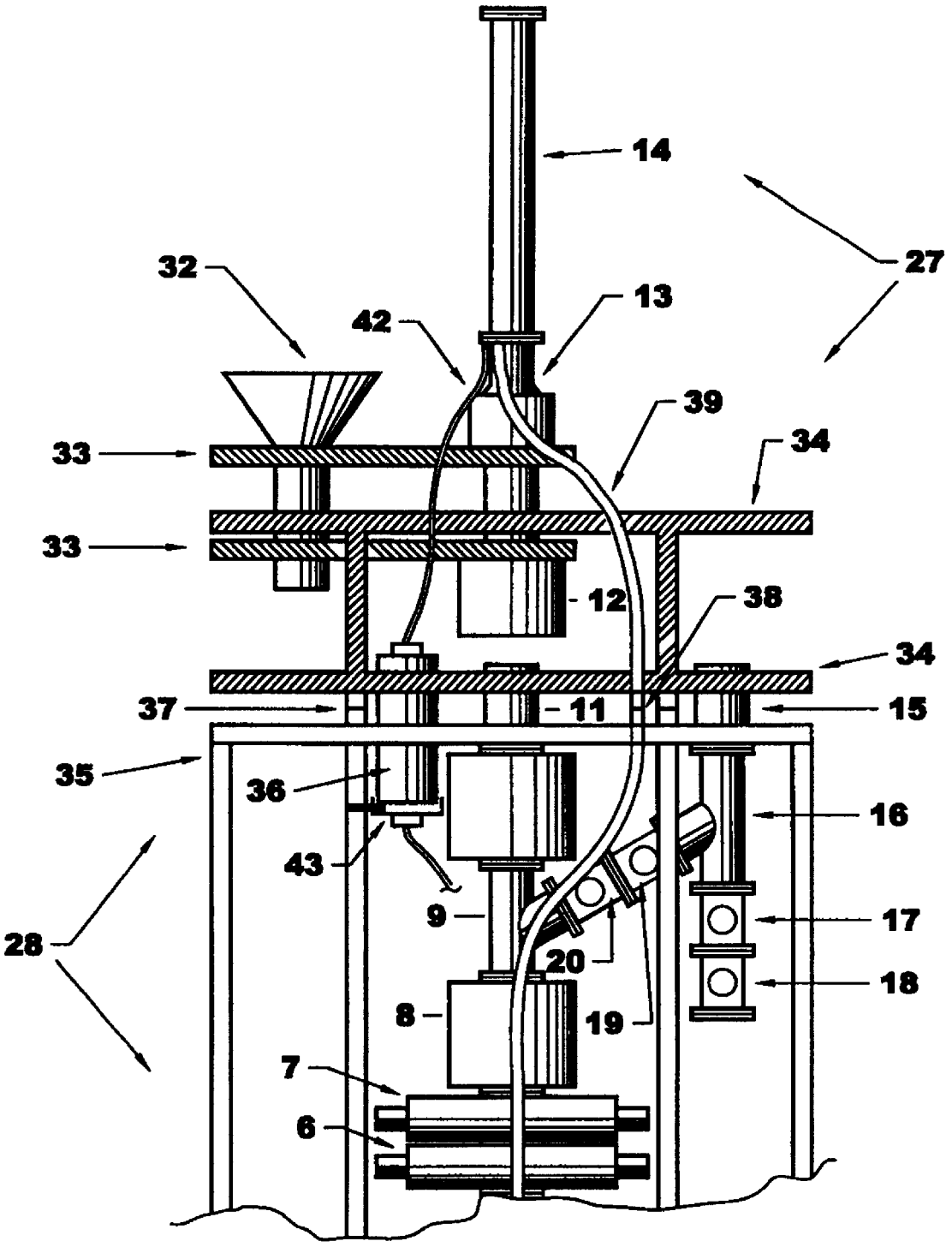
FIG. 15 is an enlarged view illustrating the operation of the lifting and guide frame assembly when the lower marine riser package is disconnected from the BOP stack.
Figure 19A:
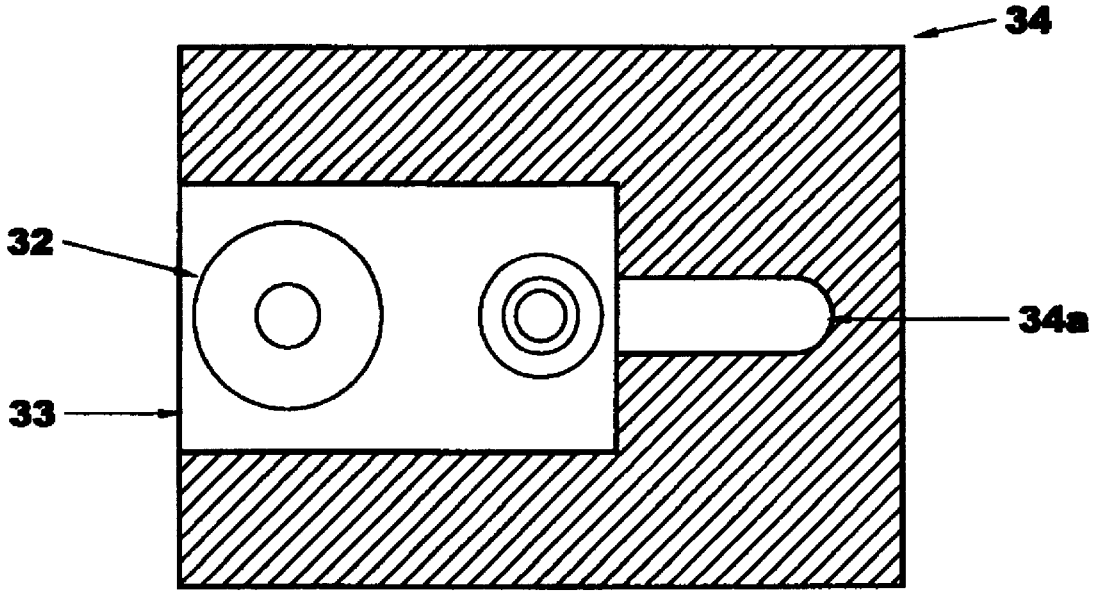
FIG. 19 is a top view illustrating the movement of the upper lifting frame relative to the lower guide frame.
Figure 19B:
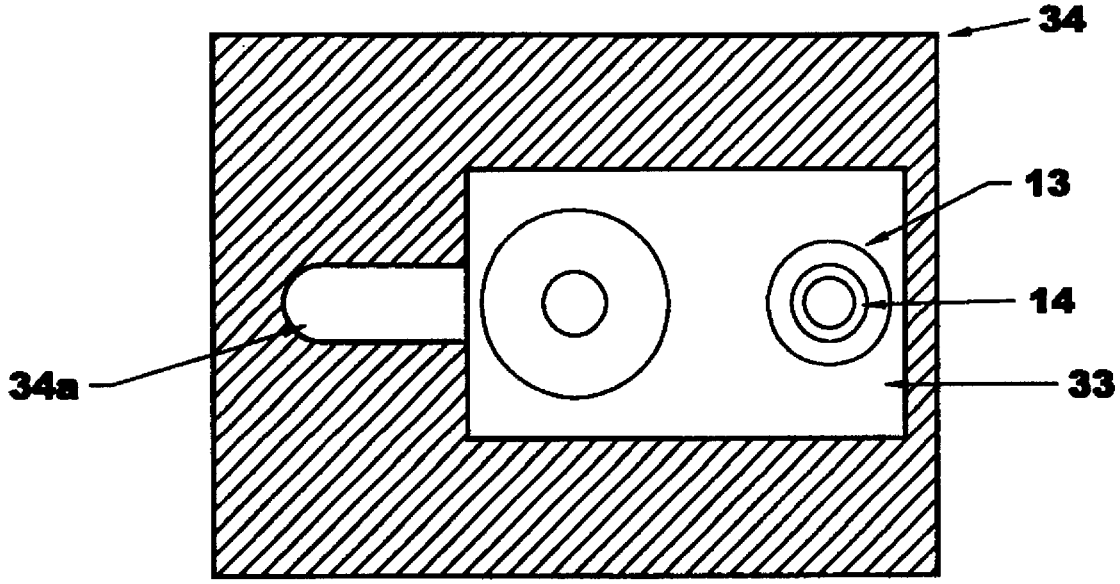

FIG. 18 shows a plan view of the upper lifting frame 33 with guide funnel 32 and drilling riser 14. Also shown is lower guide frame 34 containing a slot 34*a* which allows the upper lifting frame 33 and its attached components to move vertically and horizontally within the restricted confines of slot 34*a*. Vertical movement of the lower marine riser package 27 relative to the lower guide frame is determined by the distance between the upper and lower plates of the upper lifting frame 33. As illustrated in FIG. 15, once connector 12 has been released, the vertical travel of the lower marine riser package and the riser is restricted by the contact of the lower plate of lifting frame 33 with the top plate of guide frame 34. FIG. 19 shows the range of horizontal movement of upper lifting frame 33 within slot 34*a*. This permits the drilling riser 14 to be moved from a position above the BOP stack 28 to a position above the mud return mandrel 15 in a restricted and controlled manner.

Alternatively, the vertical travel of the lower marine riser package 27 relative to the guide frame can be accomplished without the upper lifting frame. In such arrangement, the vertical travel of the lower marine riser package would be upwardly limited by the contact of the top of the enlarged diameter portion of connector 12 with the top plate of lower guide frame 34. The smaller diameter portion of connector 12 would be positioned within slot 34*a* for controlling the lateral movement of the lower marine riser package with respect to the blowout preventer stack.

Figure 20A:
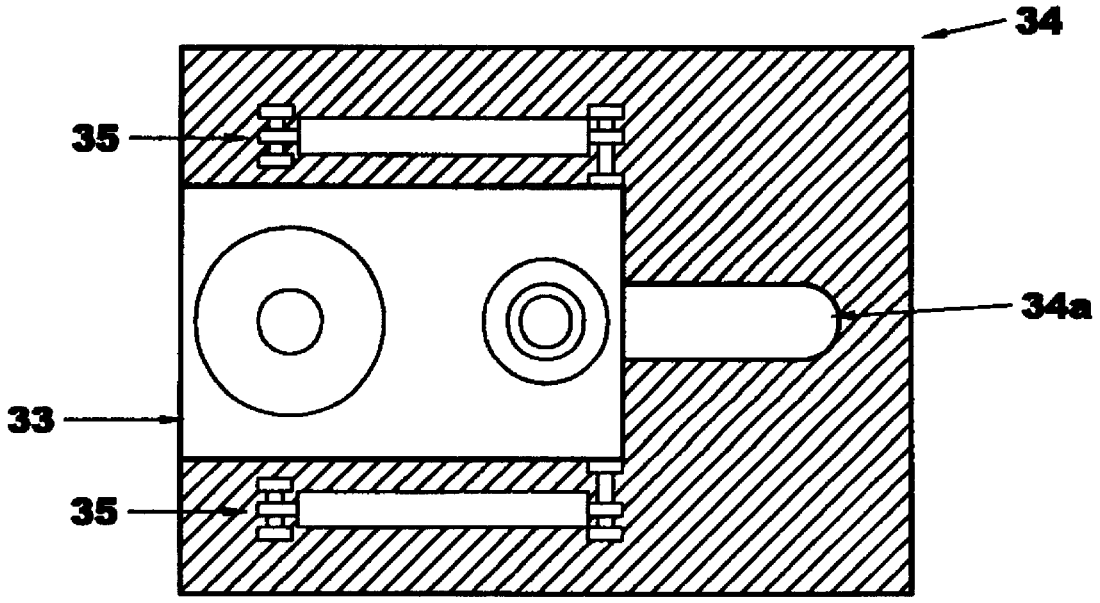
FIG. 20 is a top view of the upper lifting frame being moved relative to the lower guide frame by means of hydraulic rams.
Figure 20B:
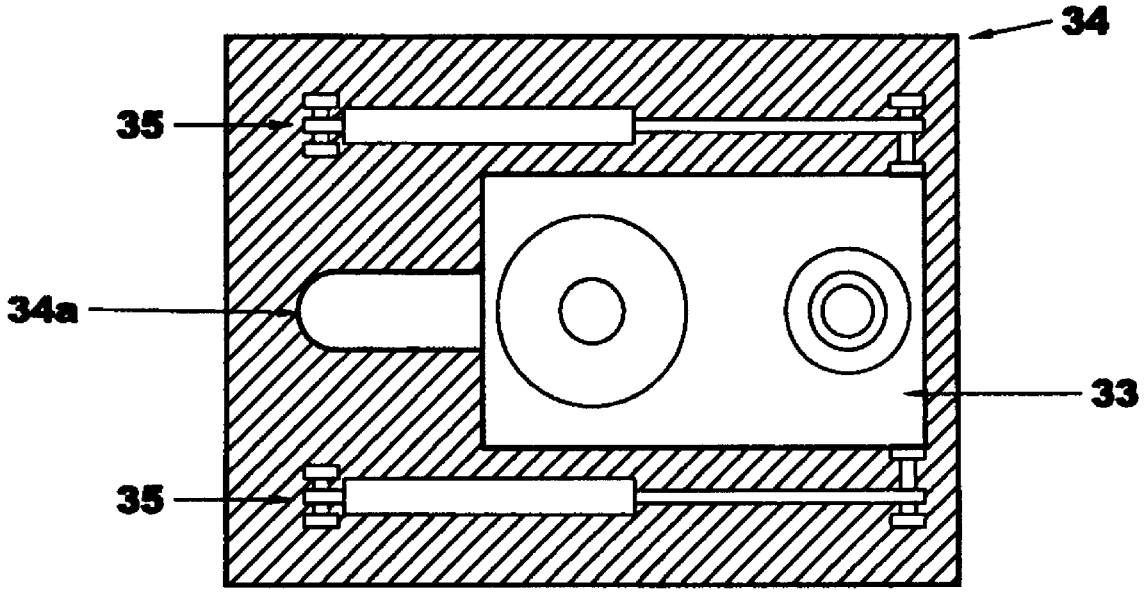
Figure 21A:
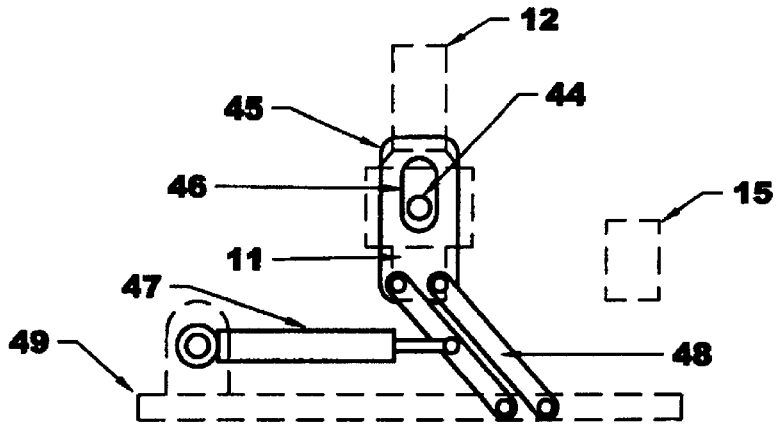
FIG. 21 is an elevational view of four stages in the movement of the drilling riser by an alternative mechanism comprising a guide pin, guide frame with slot, guide arms and hydraulic rams.
Figure 21B:
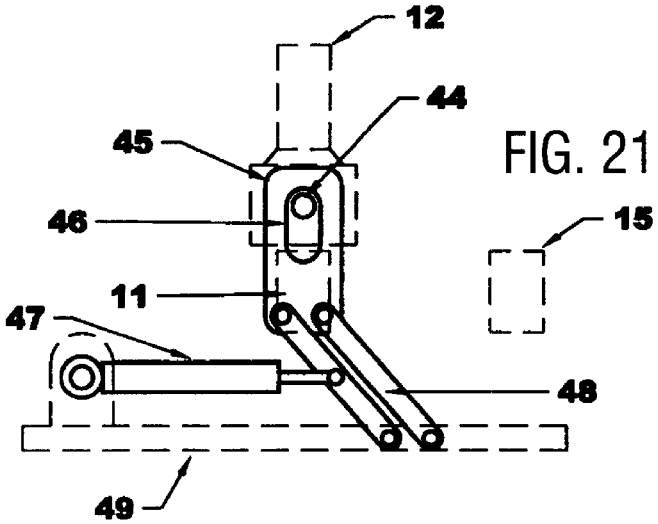
Figure 21C:
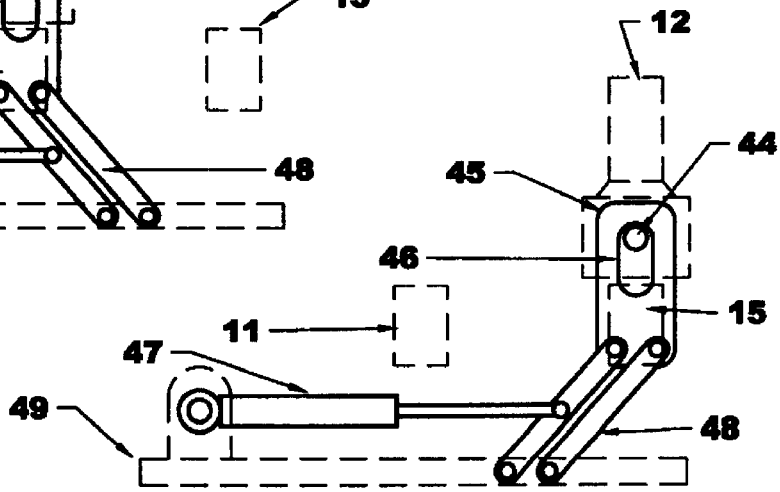
Figure 21D:
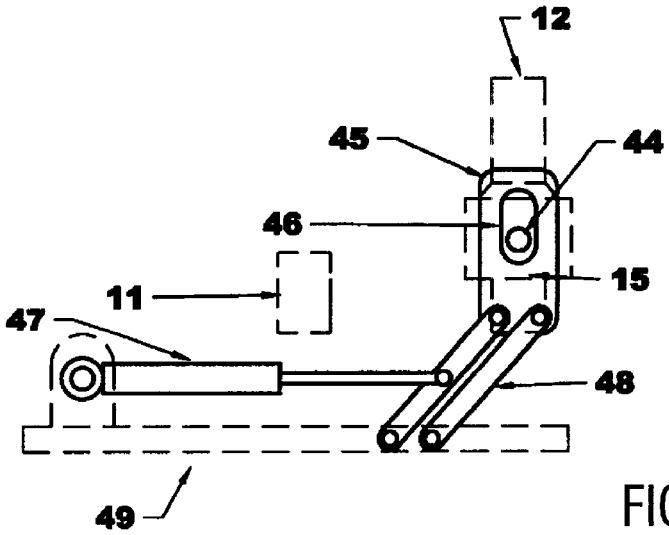
Figure 22A:
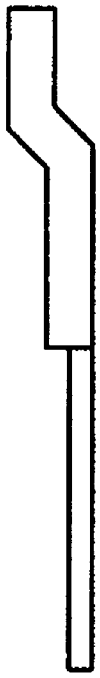
FIG. 22 illustrates a 30" wellhead housing for use in conjunction with the deep ocean drilling system of the present invention.
Figure 22B:
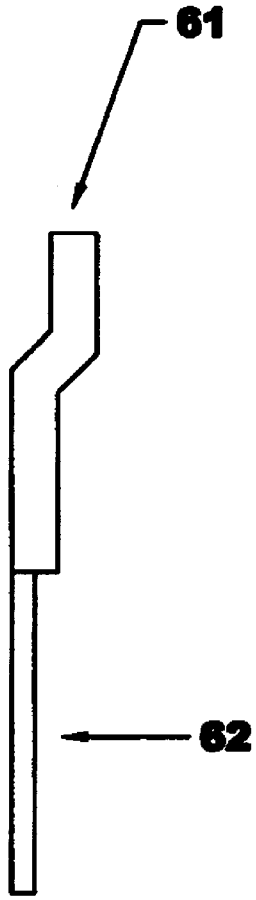

Movement of the drilling riser may be effected by relocating the drilling rig 22 sufficiently to allow the drilling riser to swing over beneath it. The swing is restricted and contained by the lifting and guide frame assembly and slot 34*a* arrangement. An alternative to relocating the drilling rig 22 is to attach hydraulic rams between the upper lifting frame and the lower guide frame and hydraulically drive the upper lifting frame 33 to alternative locations within the confined of slot 34*a*. FIG. 20 shows the upper lifting frame 33 and guide frame 34 with attached hydraulic rams 35. Hydraulic rams 35 are pivotably attached at their lower end to lower guide frame 34 and at their upper end to upper lifting frame 33.

FIGS. 14–16, 18 and 19 illustrate in more detail how the drilling riser 14, lower flex joint 13 and lower marine riser package connector 12 may be hydraulically disconnected from the blowout preventer stack and moved in a controlled manner along a controlled pathway and connected to the mud return assembly in accordance with one embodiment of the present invention. Throughout the process, choke and kill lines 39, pod control lines 42 and other service lines such as television electric cables (not shown) must be connected to the blowout preventer stack at all times. In addition these lines must be protected from damage while the riser is being moved. The lower marine riser package connector mandrel 11 must also be protected while lowering casing and other components inside the wellbore and these components must be guided into the lower marine riser package connector mandrel 11 opening.

FIG. 15 shows the riser 14, lower flex joint 13 and lower marine riser package connector 12 disconnected from lower marine riser connector mandrel 11 and raised to allow lower marine riser package connector 12 to clear the lower marine riser connector mandrel 11. These components are vertically restrained from moving further than desired by lower guide frame 34 which remains connected to blowout preventer stack support frame 35 by means of guide frame connectors 37.

Figure 14:
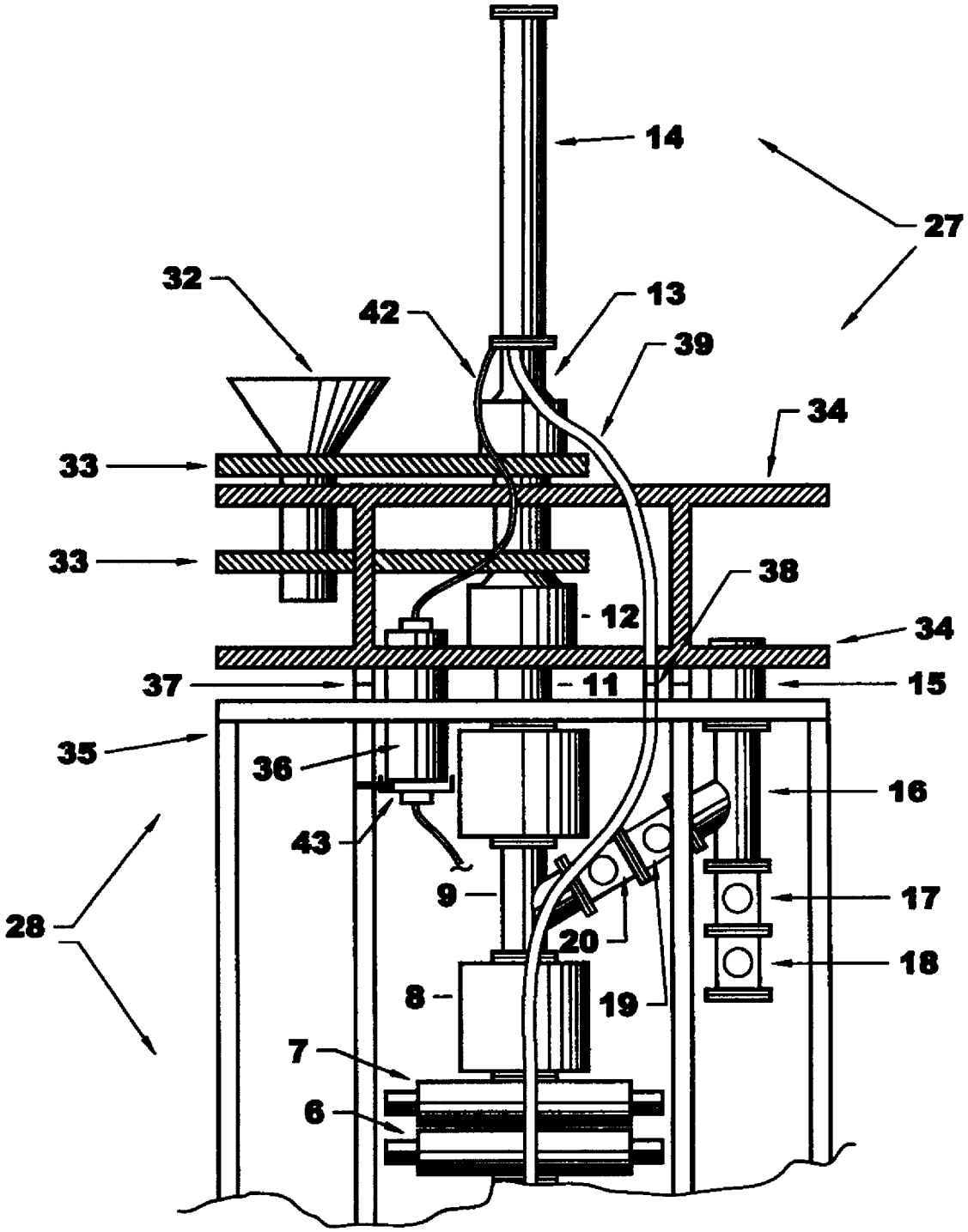
FIG. 14 is an enlarged view of the lifting and guide frame assembly for the lower marine riser package and the BOP stack.
Figure 16:
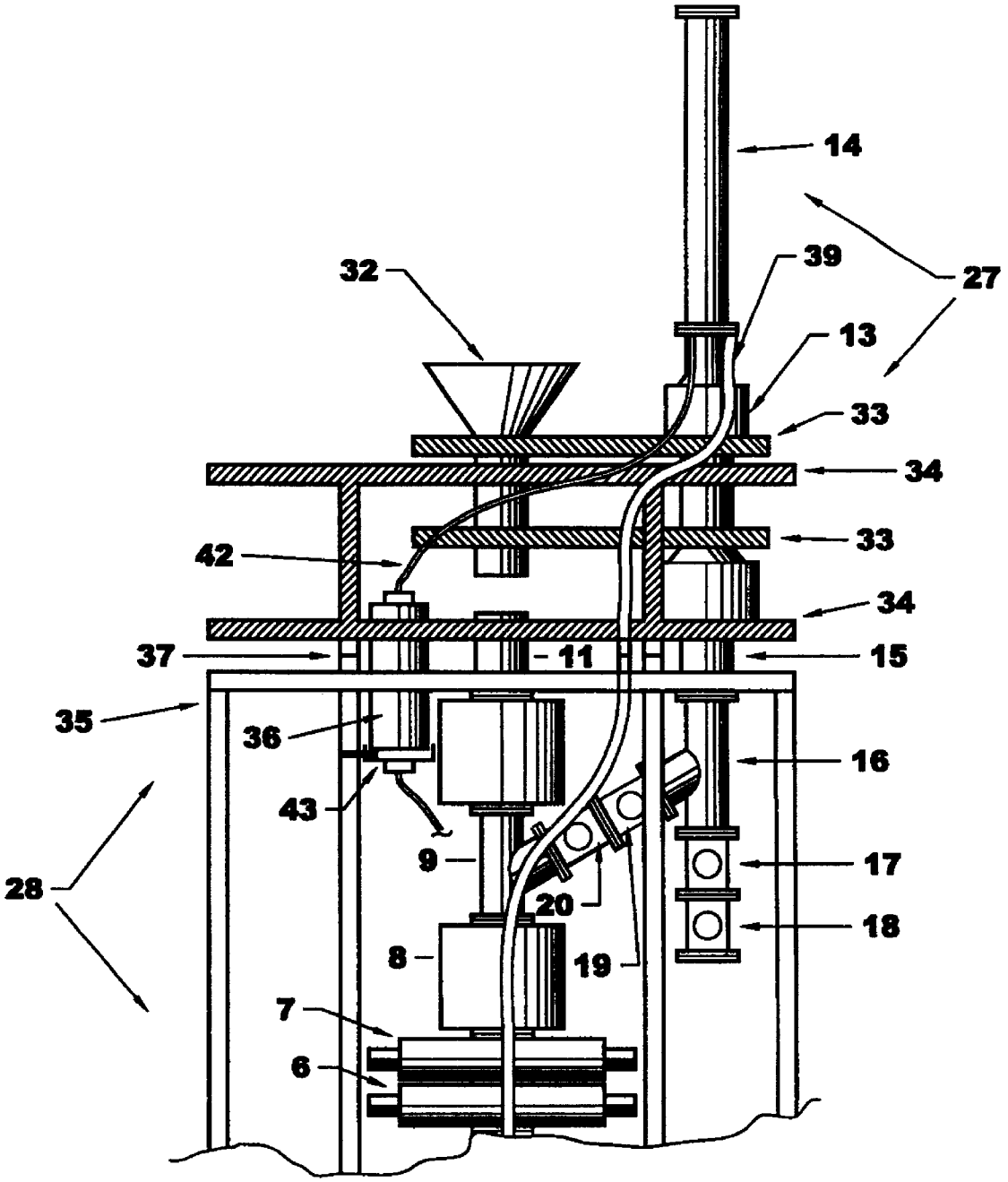
FIG. 16 is an enlarged view of the lifting and guide frame arrangement when the lower marine riser package is connected to the mud return assembly.

FIG. 16 shows the riser 14, lower flex joint 13 and lower marine riser package connector 12 moved over to a position directly above the mud return assembly and connected to the mud return mandrel 15. The lateral movement of these components is restricted by slot 34*a* in lower guide frame 34. Guide funnel 32 is in position directly above the blowout preventer stack to protect the lower marine riser package connector mandrel and to guide casing or drilling tools into and out of the wellbore. As shown in FIGS. 14–16, choke and kill lines 39, pod control lines 42 and the other service lines remain connected to the blowout preventer stack throughout this operation.

Figure 17:
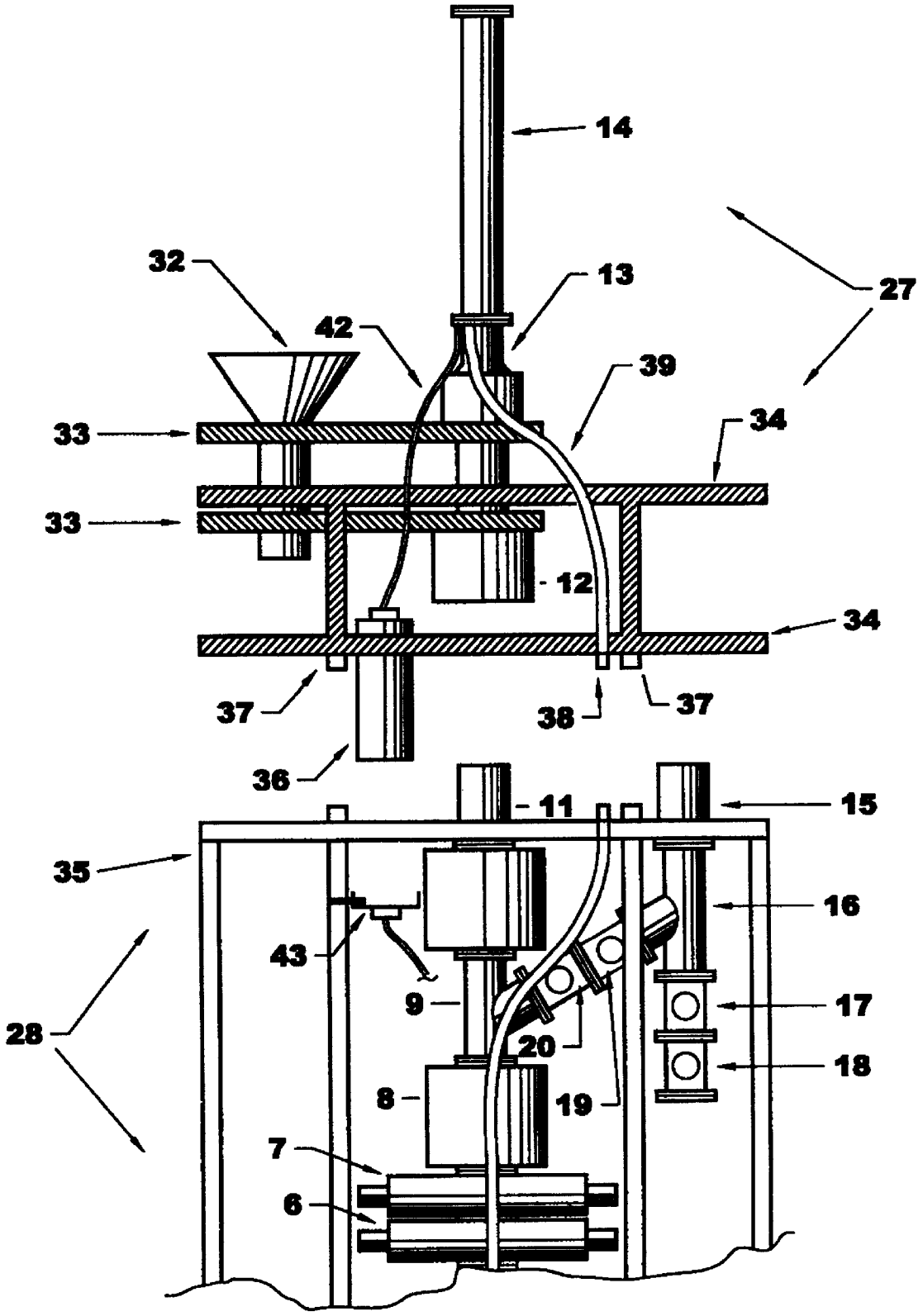
FIG. 17 is an enlarged view of the disconnection of the drilling riser and the lifting and guide frame assembly from the BOP stack.

In the event of an emergency that requires the disconnection of the drilling riser 14 from the blowout preventer stack 28, the control pod 36, choke and kill line connectors 38 and guide frame connectors 37 are released from the blowout preventer stack allowing the drilling riser joints 14, lower marine riser package 27, lower guide frame 34, control pods 36, choke and kill lines 39 and other service lines (not shown) to be retrieved from the blowout preventer stack to the drilling vessel 22 as shown in FIG. 17. The release is accomplished by means of the electro-hydraulic BOP control system which operates the required connectors in sequence to effect the disconnect. When the connectors have been released, the riser string 14 and lower marine riser package 27 are raised clear of the blowout preventer stack 28 by using the riser tensioners 24 or hoisting equipment 21 on the drilling vessel 22. This disconnection process can be conducted with the riser 14 and lower marine riser package 27 in any position.

The riser relocation may be accomplished by reducing the riser tension on the tensioners to the point where tension at the lower marine riser package connector 12 is slightly positive, releasing the connector which will be pulled free of the lower marine riser package mandrel by increasing the tension on the riser tensioners, and then repositioning the connector over the mud return mandrel. After the connector has been transported to the secondary location over the mud return mandrel, the tensioners can be slacked slightly to land the connector on the mandrel and the connector re-latched before tension is increased to the required amount. Alternatively, the upper end of the riser may be supported by the rig hoist and drawworks system during this process, and the transfer may be accomplished by maneuvering the vessel while the riser is supported by the hoist. If the hydraulic ram assembly illustrated in FIG. 20 is utilized, the riser is hydraulically driven from mandrel 11 to mud return mandrel 15, or vice versa, by hydraulic rams 35 after the lower marine riser connector 12 has been released and pulled free from the respective mandrel to which it had previously been connected.

An alternative means for relocating the drilling riser 14 is shown in FIGS. 21(*a*), (*b*), (*c*), and (*d*). In FIG. 21(*a*) lower marine riser package connector 12 is shown attached to lower marine riser connector mandrel 11. Guide pin 44 attached to lower marine riser package connector 12 is retained within a vertical slot 46 formed in guide plate 45. The guide plate 45 is attached to lower marine riser package guide frame 49 by means of parallel arms 48 which are pivotably attached at their lower ends to frame 49 and at their upper ends to the lower end of plate 45. The position of the lower marine riser connector 12 and hence drilling riser 14 is controlled in the vertical plane by hoisting and lowering to the extent permitted by guide pin 44 within vertical slot 46 and in the horizontal plane by actuating hydraulic ram 47 to move the lower marine riser connector 12 and hence drilling riser 14 back and forth to the extent permitted by the hydraulic ram 47 and parallel arms 48.

In FIG. 21(*b*) the lower marine riser connector 12 (and drilling riser 14) has been disconnected from lower marine riser mandrel 11 and hoisted upwards until guide pin 44 reaches the top of vertical slot 46. Hydraulic ram 47 remains in the fully retracted position. In FIG. 21(*c*) hydraulic ram 47 has been extended fully driving lower marine riser connector 12 (and hence drilling riser 14) to a position directly above mud return mandrel 15. In FIG. 21(*d*) the lower marine riser connector 12 (and hence drilling riser 14) has been lowered over and connected to mud return mandrel 15. The guide pin 44 is now at the lower end of vertical slot 46.

Although not shown, lower marine riser package guide frame 49 may be releasably connected to blowout preventer stack 28 with guide frame connectors in the s same manner that guide frame connectors 37 connected lower guide frame 34 to the BOP stack. Similarly, choke and kill lines, pod control lines and other service lines remain connected at all times to the blowout preventer stack by means of a control pod and choke and kill line connectors during the relocation of the lower marine riser package between mandrel 11 and mud return mandrel 15, or vice versa, using the arrangement shown in FIGS. 21(*a*)–21(*d*).

A fundamental part of this present invention is the BOP stack arrangement which allows full well control operations during the entire course of the well. This requires that the choke and kill lines, riser booster lines (if required), and all sub-sea and BOP controls be fully functional when the riser is in the alternative position, i.e., disconnected from the top of BOPs and connected to the alternative support station of the mud return assembly. The alternative support station is an integral part of the BOP stack frame, and is further equipped with a conduit and appropriate valves, which allow mud returns from beneath the upper, annular blowout preventer. This is to allow mud to be displaced into the riser when said annular is fully or partially closed as in stripping operations.

The upper end of the riser 14 is supported by a telescoping joint, which is attached to a diverter under the rotary table, and axially in the well path. While Ilfrey et al proposed shifting the upper end of the riser out of the well path, in the preferred embodiment of the present invention illustrated in FIG. 9, the upper end of the riser is not disturbed, and the 13⅜" casing is run and landed using auxiliary hoist 23 located several meters from the primary hoist. The auxiliary hoist is preferably motion compensated and equipped with a rotary table. Use of auxiliary hoist 23 allows an operator to make up and suspend the 13⅜" string vertically proximate to the top of the subsea BOP stack prior to the completion of the 17½" hole section. Upon completion of the 17½" hole section and the relocation of the riser to the mud return assembly, valuable rig time is saved by lowering the already suspended 13⅜" casing through the BOP stack and into the wellbore.

The 13⅜" casing is run through open water into the BOP stack, the casing hanger is landed in the wellhead, and the casing cemented. Displaced mud during these operations may be to the ocean floor through the open BOPs, or the annular preventer 10 may be closed and the string stripped into the hole with resulting returns to the rig via the marine riser. In the event the well begins to flow during the running of the 13⅜" casing, annular preventer 10 may be closed about the casing and the casing string stripped into the hole while maintaining wellbore control via the mud return assembly. Alternatively, by taking mud returns through the riser via the mud return assembly, the mud returns may be monitored while running the casing to verify that the correct amount of mud is being displaced by the casing and the well is not beginning to flow. Thus, the mud return assembly of the present invention provides improved well safety during the open water casing operations.

The BOP stack arrangement must conform to certain regulatory standards which establish the type and quantity of ram and annular preventers, but generally a BOP stack will consist of a wellhead connector, three to five ram preventers, one or two annular preventers, and lower marine riser package mandrel as shown in the attached figures. For purposes of the present invention, it will be understood that a high pressure BOP stack shall mean a BOP stack having ram preventers rated for 10,000 psi or higher service. The lower marine riser package mandrel provides a connection for the lower marine riser package connector and allows the riser to be connected and disconnected to the top of the BOP stack. The lower marine riser package (LMRP) consists of the riser connector attached to the riser with a flexible joint, the choke and kill line connectors, and control pods. As shown in FIG. 14, the BOP stack is integrated and supported by a steel support frame fixed at various points to the BOP components The subsea BOP stack may consist of a number of main and auxiliary components that are unitized or integrated within the support frame. The support frame serves other functions such as mechanical support for components, handling, support, and to stabilize the stack when the stack is lifted and placed on the deck of the drilling vessel. The frame is usually made up of four vertical tubular members spaced around the BOP stack, each connected to the adjacent one by means of tubular cross braces and bolted flanges. The LMRP may include a guide frame assembly which may interface with the main stack frame. The steel frames are usually built with bolted flanges to allow portions to be removed for access to BOP components.

The blowout preventer stack for the present invention is similar, but includes an alternative mandrel 15 for the LMRP adjacent to the primary mandrel and supported by and fixed to the BOP stack and/or support frame. This mandrel 15 is connected by a conduit and suitable valves to the wellbore below the upper annular preventer, so that when the upper annular preventer of the BOP is closed, the well returns may be diverted to the alternative riser connector (mud return) mandrel 15. Additional valves allow the alternative riser connector mandrel 15 to be opened to the sea. This manifold of valves also allows well returns to flow up the riser when the latter is in the alternative location, or to flow to the sea. It also allows the riser or the well to be flooded with sea water.

Conventional 18¾" high pressure subsea wellhead systems generally have a through bore diameter of about 18¾" down to the casing hanger shoulder. The shoulder or landing ring whereon the 13⅜" casing hanger is landed bears the vertical load of the casing string. A seal and lock down is usually installed above the landing ring between the casing hanger and the bore of the wellhead. Each subsequent casing hanger lands on top of the preceding hanger, and is sealed and locked down to the 18¾ wellhead bore. The 13⅜" casing hanger typically bears the vertical load for all smaller casing strings, and transfers this load to the 18¾" wellhead housing. Since all casing hangers in this system have an external diameter of about 18⅝", the casing hangers cannot pass through the nominal 15" marine riser.

One embodiment of the present invention contemplates a novel wellhead wherein the 13⅜" casing hanger lands on the 18¾" wellhead landing ring and seals against the bore of the wellhead housing as in conventional technology. The 13⅜" casing hanger, however, will be extended in length as required and its internal bore will include a landing means for the 9⅝" casing hanger. The 9⅝" hanger will in turn be sealed against and locked down in the 13⅜" casing hanger bore. Subsequent casing and tubing hangers will be landed inside the 13⅜" casing hanger and stacked upon on the 9⅝" hanger. This will allow all casing strings, hangers, and wear bushings subsequent to the 13⅜" casing to pass through the 15" marine riser.

The operation of the system with the novel wellhead for a typical subsea well system consisting of 30", 20", 13⅜", 9⅝", and 7" casing strings and 4½" production tubing string is illustrated in FIGS. 22 through 27.

Figure 23:
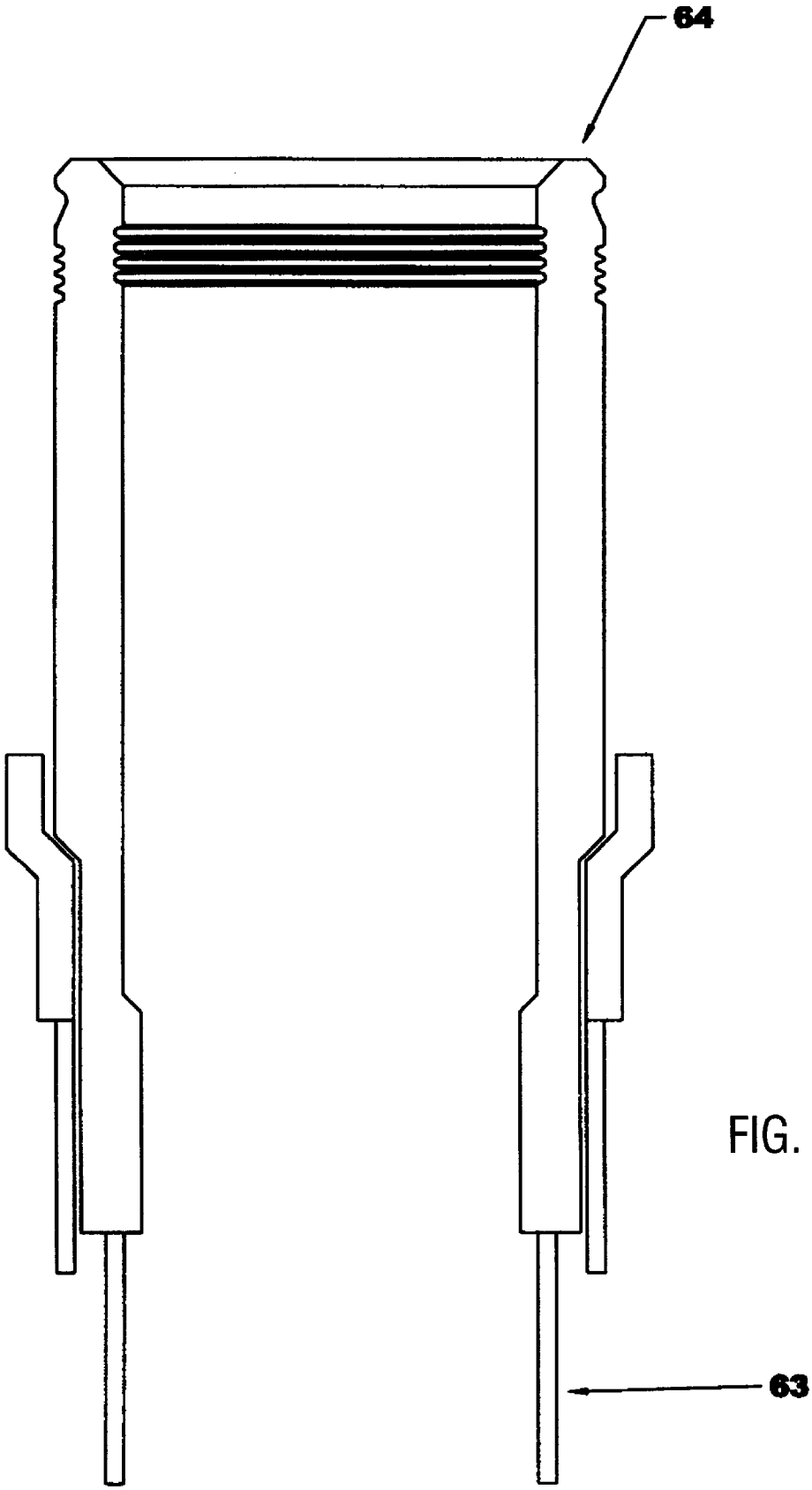
FIG. 23 illustrates an 18¾" wellhead housing landed inside the 30" wellhead housing according to one embodiment of the present invention.

The 30" conductor 62 is drilled or jetted into place conventionally with a 30" wellhead housing 61 attached. The 26" hole section is drilled next and 20" casing 63 run. Attached to the top of the 20" casing 63 is 18¾" wellhead housing 64 which is configured to operate with the proposed well system. The 18¾" wellhead housing 64 lands off inside the 30" wellhead housing 61 conventionally as shown in FIG. 23.

Figure 24:
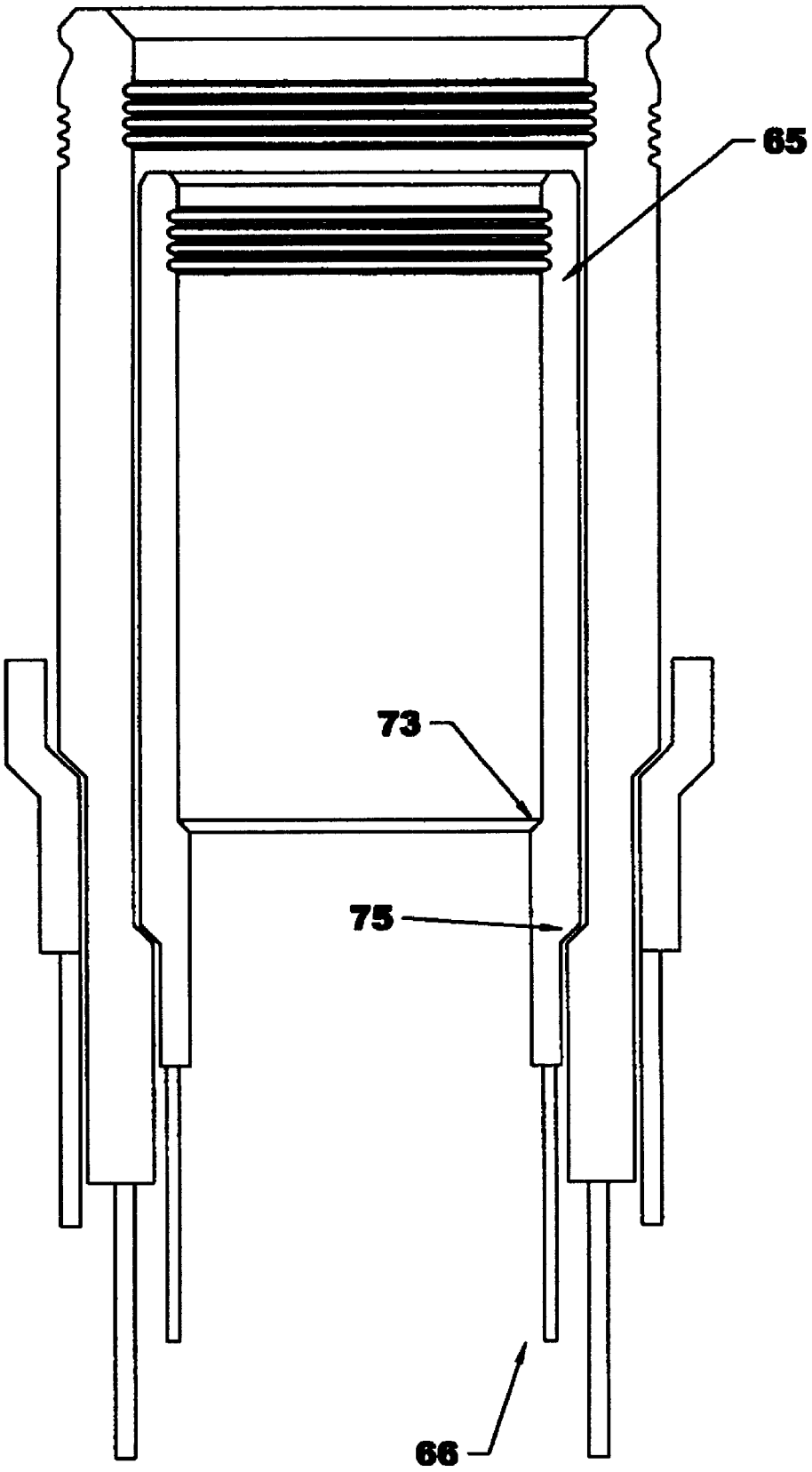
FIG. 24 illustrates the 13⅜" casing hanger landed inside the 18¾" wellhead housing.

The 17½" hole section is then drilled and 13⅜" casing 66 run. The 13⅜" casing is attached to a novel casing hanger which lands on the landing shoulder of wellhead housing 64 as shown in FIG. 24. The 13⅜" casing hanger 65 is configured to permit the internal hang-off and sealing of all subsequent casing hangers and the tubing hanger. In the preferred embodiment, the internal bore of the 13⅜" hanger is machined to include a landing shoulder 73 for the 9⅝" casing hanger. Alternatively, the internal bore may be configured to include other known landing means such as a hardened landing ring or grooves for receiving load rings attached to the subsequent casing hangers.

Figure 25:
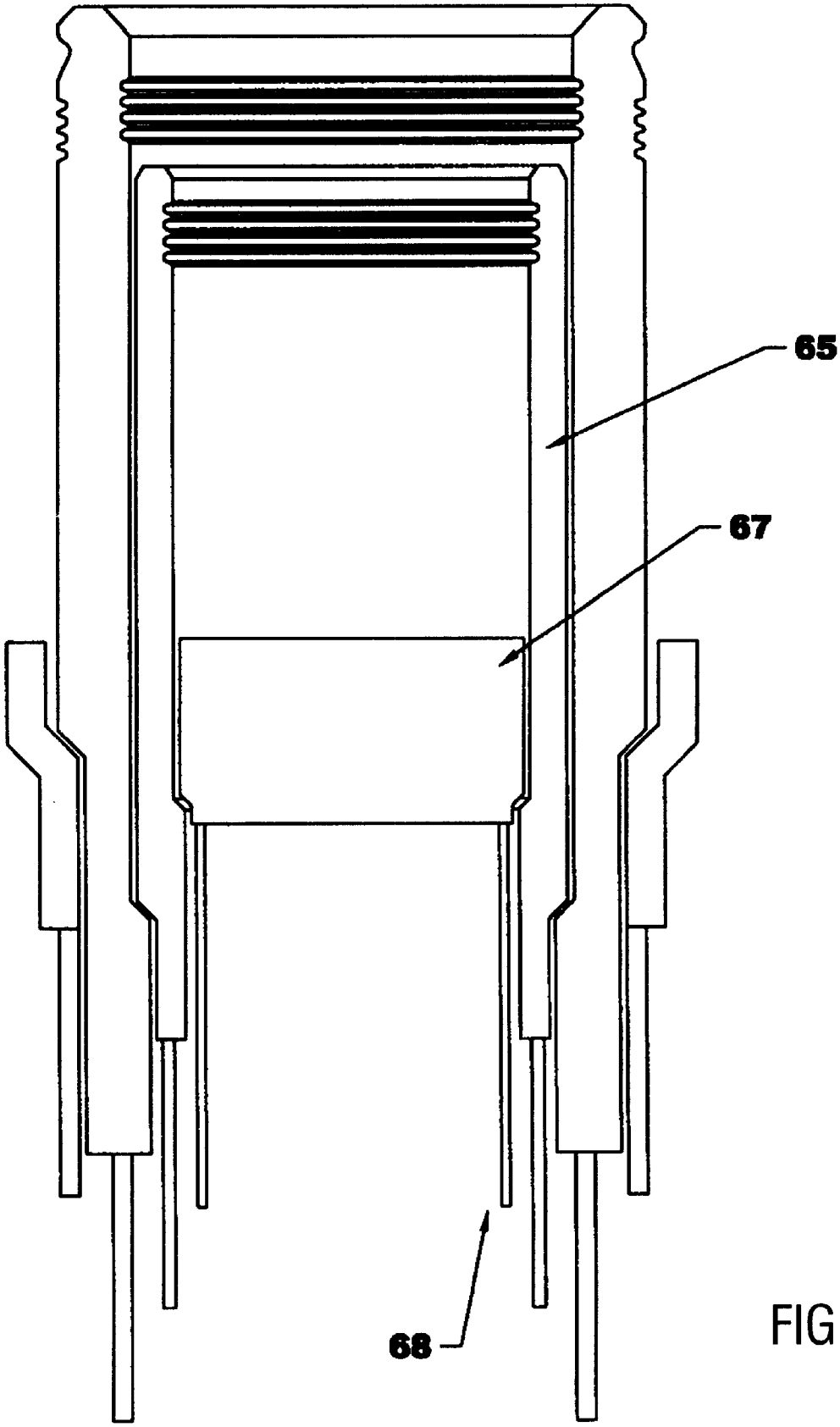
FIG. 25 illustrates the 9⅝" casing hanger landed inside the 13⅜" casing hanger.
Figure 26:
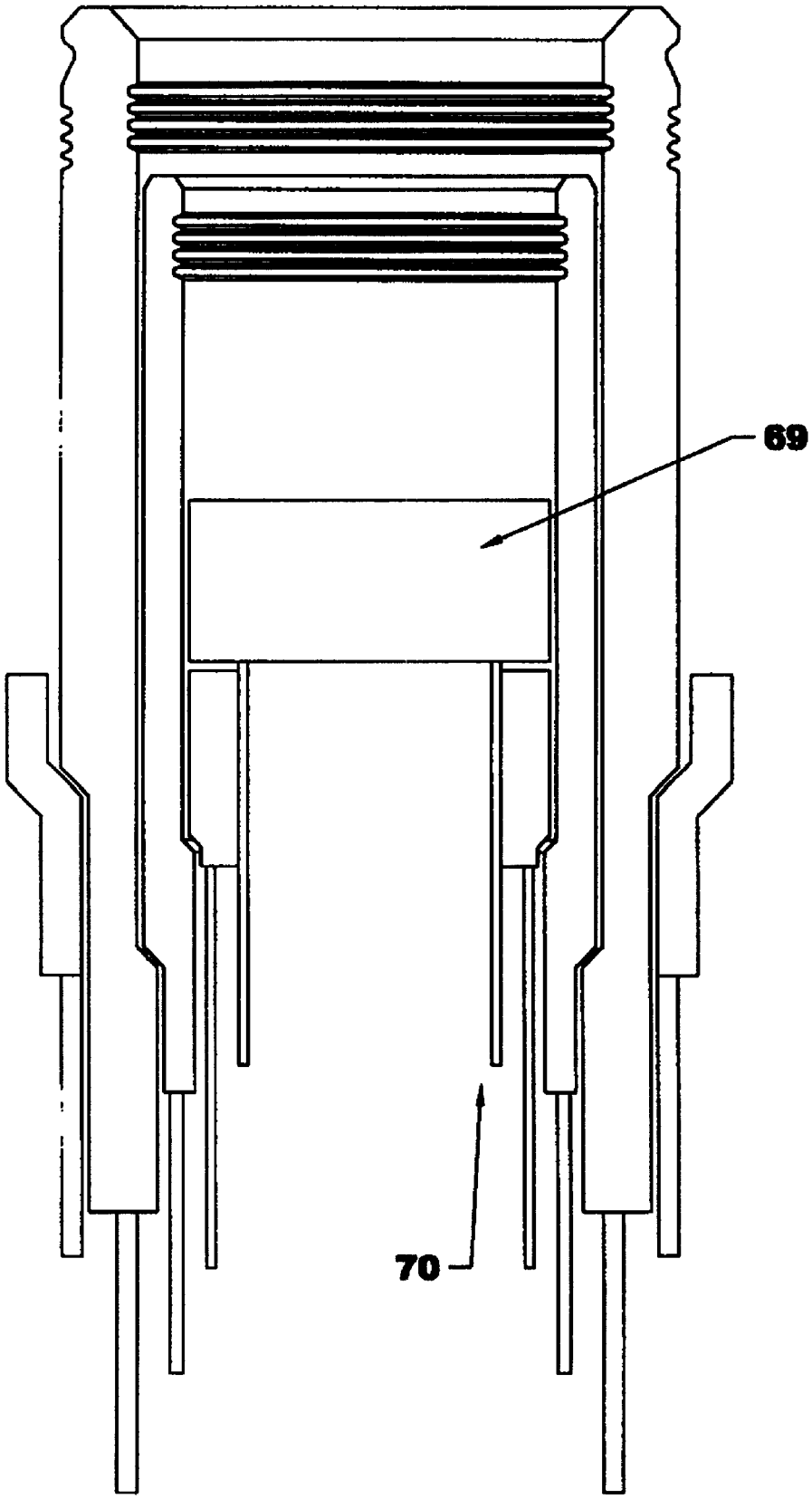
FIG. 26 illustrates the 7" casing hanger landed inside the 13⅜" casing hanger.

Next, the 12¼" hole is drilled and 9⅝" casing 68 is run into the well. The 9⅝ casing hanger 67 is landed on the landing shoulder inside the 13⅜" casing hanger 65 as shown in FIG. 25. Similarly, the 8½" hole section is drilled and 7" casing 70 is run into the well. The 7" casing may be hung off in the 9⅝ casing as a liner or extend back to surface. In the later case, a 7" casing hanger 69 is landed in the 13⅜" casing hanger 65 as shown in FIG. 26.

Figure 27:
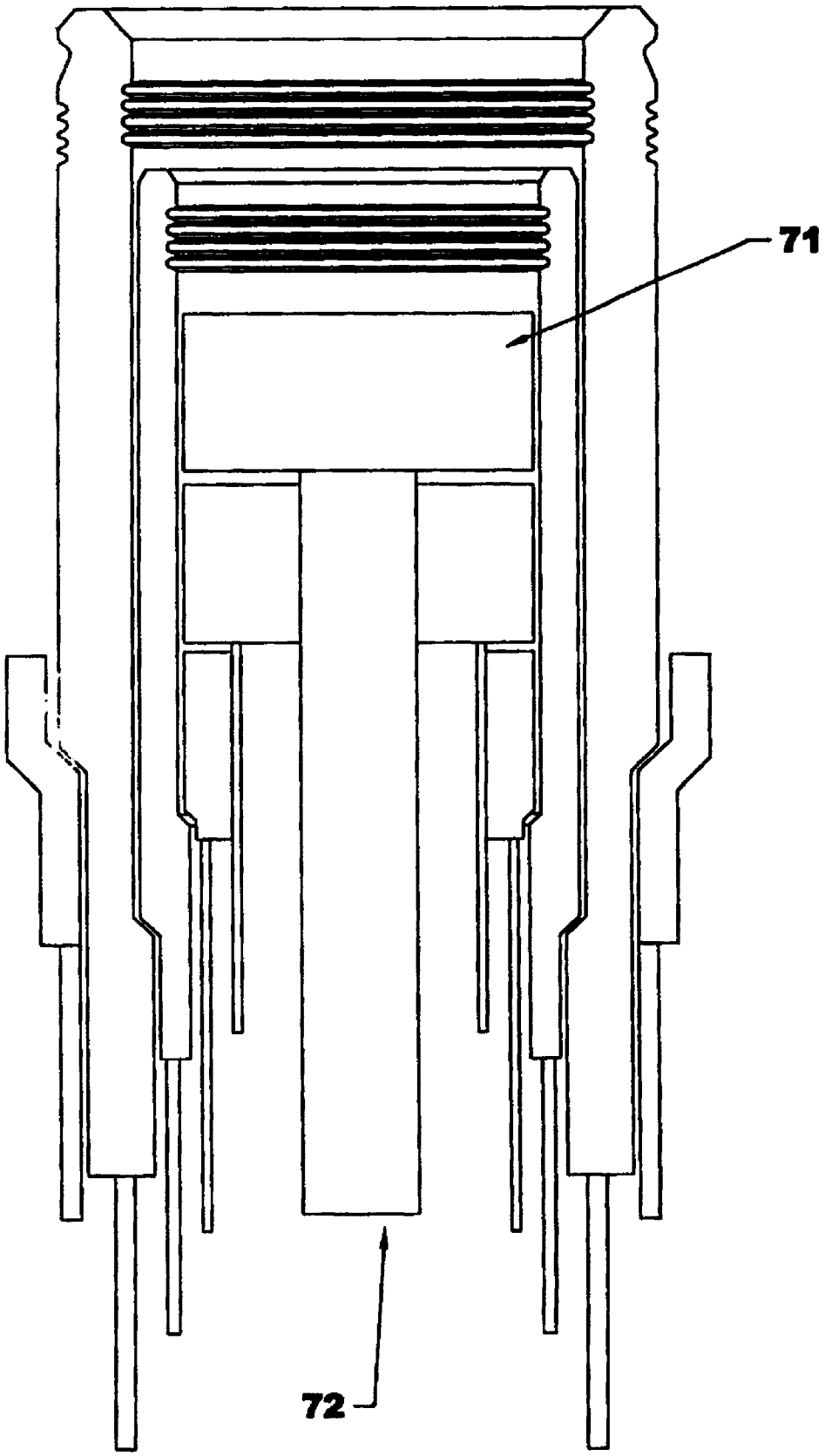
FIG. 27 illustrates a tubing hanger landed inside the 13⅜" casing hanger according to one embodiment of the present invention.

Afterwards, production tubing 72 and tubing hanger 71 are run and landed inside the 13⅜" casing hanger 65 as shown in FIG. 27. The 13⅜" casing hanger 65 supports the vertical load of the 9⅝" casing, the 7" casing and the tubing string. This load is transmitted through load shoulder 75 to the 18¾" wellhead housing.

While the description of the preferred embodiment of the invention contemplates the use of a 15" riser and running only the 13⅝" casing string outside the riser, even smaller risers might be employed. For example, an approximately 11½" riser could be used with appropriate modifications to the wellhead equipment, casing and tubing hangers, and procedure. This would allow all hole sections under the 9⅝" casing to be conducted conventionally assuming the wellhead has been reconfigured to accommodate smaller diameter hangers for 7" (or smaller) casing and tubing.

Alternatively, the riser may be located on the mud return mandrel during the entire course of the well, with well equipment stripped through or staged through the blowout preventers. Should drilling be contemplated while the riser is connected to the mud return mandrel, mud circulated through the drilling bit must be diverted to the riser for return to the drilling vessel. This requires sealing the annular area around the drill string above the diverter spool. The drill string has a somewhat irregular profile as the drillpipe joints have a larger outside diameter than the remainder of the drillpipe body. In one embodiment of the invention, the seal would be effected by energizing the upper annular preventer to the extent that the element seals against the drillpipe, but not so tightly that the pipe is immobilized. This is accomplished by regulating the hydraulic pressure in the annular preventer closing and/or opening chambers. An accumulator may be required in the hydraulic circuit to allow a volume of hydraulic fluid to be displaced, and thus maintain a constant pressure, as the preventer element is forced open by a tool joint passing through the preventer. This operation is referred to as "stripping" and is well known in the art. The wear on the blowout preventer element at constant actuation pressure is proportional to the distance the pipe moves, and the element will tolerate a fair amount of linear motion without undo wear. The wear on the preventer element increases if the drillpipe is rotated. Accordingly, according to one embodiment of the invention, a downhole motor is used to rotate the drill bit while the drillpipe would only be rotated very slowly when required, if at all. Alternatively, a full opening rotating head may be utilized during drilling operations where the riser is located on the mud return mandrel. The sealing element of the rotating head rotates within the apparatus while sealing against the drillpipe, dramatically reducing wear on the element due to such rotation. Rotating head blowout preventers are well known in land drilling applications and are believed to be adaptable to work in subsea environments.

Other modifications and embodiments of the present invention are possible without departing from the scope thereof. All matter herein set forth and shown in the accompanying drawings is intended to be illustrative and not limiting. Accordingly, the foregoing description should be regarded as illustrative of the invention as defined by the claims appended hereto.

What is claimed is:

1. A deep ocean drilling system for drilling an offshore well from a floating drilling vessel comprising:

a) a reduced diameter marine riser extending from the floating drilling vessel to a lower marine riser package connector;

b) a retrievable, high pressure blowout preventer stack having one or more annular preventers, one or more ram preventers, and a lower marine riser package mandrel, wherein the lower marine riser package connector may be releasably connected to the lower marine riser package mandrel;

c) a fluid diverter line extending from the blowout preventer stack to a fluid return mandrel, wherein the lower marine riser package connector may be releasably connected to the fluid return mandrel; and d) a retrievable lifting and guide frame assembly comprising an upper lifting frame connected to the lower marine riser package connector and a lower guide frame connected to the blowout preventer stack, wherein the lower marine riser package connector and the upper lifting frame are vertically and laterally moveable about a slot formed in the lower guide frame to maintain the axial alignment of the riser and provide a pathway for controlled movement of the riser between the lower marine riser package mandrel and the fluid return mandrel.

2. The deep ocean drilling system of claim 1 further comprising choke and kill lines, hydraulic power and control lines extending from the drilling vessel to the blowout preventer stack, wherein such lines remain functional when the lower marine riser package connector is disconnected from the lower marine riser mandrel and transferred and reconnected to the mud return mandrel.

3. The deep ocean drilling system of claim 2 wherein the choke and kill lines, hydraulic power and control lines remain functional when the lower marine riser package connector is disconnected from the mud return mandrel and transferred and reconnected to the lower marine riser mandrel.

4. The deep ocean drilling system of claim 3 wherein the choke and kill lines, hydraulic power and control lines are protected from mechanical damage when the lower marine riser package connector is disconnected from the mud return mandrel and transferred and reconnected to the lower marine riser mandrel.

5. The deep ocean drilling system of claim 2 wherein the choke and kill lines, hydraulic power and control lines are protected from mechanical damage when the lower marine riser package connector is disconnected from the lower marine riser mandrel and transferred and reconnected to the mud return mandrel.

6. The deep ocean drilling system of claim 2 wherein the choke and kill lines, hydraulic power and control lines are releasably connected to the blowout preventer stack.

7. The deep ocean drilling system of claim 1 wherein the blow out preventer stack, diverter line and fluid return mandrel are self-contained within a support frame.

8. The deep ocean drilling system of claim 7 wherein the lower guide frame is releasably connected to the blowout preventer support frame.

9. The deep ocean drilling system of claim 1 further comprising a riser dump valve in the fluid diverter line to allow well flow to be diverted to the sea at the wellhead, to dump heavy mud from the riser, or to allow the well to fill with sea water.

10. The deep ocean drilling system of claim 1 wherein the fluid diverter line extends from a fluid diverter spool in the blowout preventer stack.

11. The deep ocean drilling system of claim 1 wherein the blowout preventer stack includes a rotating head for sealing about the drill string when the riser is connected to the fluid return mandrel.

12. The deep ocean drilling system of claim 1 further comprising one or more hydraulic rams attached between the upper lifting frame and the lower guide frame for driving the lower marine riser package connector and the upper lifting frame between the lower marine package mandrel and the fluid return mandrel.

13. The deep ocean drilling system of claim 1 wherein the fluid return mandrel is connected to the retrievable blowout preventer stack.

14. The deep ocean drilling system of claim 1 further comprising a guide funnel attached to the lifting frame and positioned above the blowout preventer stack when the lower marine riser package connector is connected to the fluid return mandrel to guide casing and/or drilling equipment into the well.

15. A deep ocean drilling system for drilling an offshore well from a drilling vessel comprising:

a) a reduced diameter marine riser extending from the drilling vessel to a lower marine riser package connector;

b) a blowout preventer stack having a lower marine riser package mandrel, wherein the lower marine riser package connector may be releasably connected to the lower marine riser package mandrel;

c) a secondary support mandrel wherein the lower marine riser package connector may be releasably connected to the secondary support mandrel; and d) a lifting and guide frame assembly comprising an upper lifting frame connected to the lower marine riser package connector and a lower guide frame connected to the blowout preventer stack, wherein the lifting frame restricts the vertical movement of the lower marine riser package connector and a pathway in the guide frame restricts the lateral movement of the lower marine riser package connector to maintain the axial alignment of the riser and control the movement of the riser between the lower marine riser package mandrel and the secondary support mandrel.

16. The deep ocean drilling system of claim 15 further comprising choke and kill lines, hydraulic power and control lines extending from the drilling vessel to the blowout preventer stack, wherein such lines remain functional when the lower marine riser package connector is disconnected from the lower marine riser mandrel and transferred and reconnected to the secondary support mandrel.

17. The deep ocean drilling system of claim 16 wherein the choke and kill lines, hydraulic power and the control lines remain functional when the lower marine rise package connector is disconnected from the secondary support mandrel and transferred and reconnected to the lower marine riser mandrel.

18. The deep ocean drilling system of claim 17 wherein the choke and kill lines, hydraulic power and control lines are protected from mechanical damage when the lower marine riser package connector is disconnected from the lower marine riser mandrel and transferred and reconnected to the secondary support mandrel.

19. The deep ocean drilling system of claim 16 wherein the choke and kill lines, hydraulic power and control lines are protected from mechanical damage when the lower marine riser package connector is disconnected from the lower marine riser mandrel and transferred and reconnected to the secondary support mandrel.

20. The deep ocean drilling system of claim 16 wherein the choke and kill lines, hydraulic power and control lines are releasably connected to the blowout preventer stack.

21. The deep ocean drilling system of claim 15 wherein the lower guide frame is releasably connected to the blowout preventer stack.

22. The deep ocean drilling system of claim 15 wherein the secondary support mandrel is connected to the blowout preventer stack.

23. The deep ocean drilling system of claim 15 further comprising a guide funnel attached to the lifting frame and positioned above the blowout preventer stack when the lower marine riser package connector is connected to the secondary support mandrel to guide casing and/or drilling equipment into the well.

24. A method of running casing in deep water from a floating drilling vessel having a reduced diameter riser for connecting the vessel to the well comprising the steps of:

a) providing a lower marine riser package connector on the end of the reduced diameter riser to connect the riser to a lower marine riser mandrel on a high pressure blowout preventer stack;

b) disconnecting the lower marine riser package connector from the lower marine riser mandrel;

c) repositioning the riser over a secondary support mandrel on the blowout preventer stack;

d) connecting the lower marine riser package connector to the secondary support mandrel, wherein a fluid diverter line provides fluid communication between the secondary support mandrel and the blowout preventer stack; and e) lowering a 13⅜" casing string outside of the riser through the blowout preventer stack and into the well while the well is in fluid communication with the riser.

25. The method of claim 24 further comprising running the casing open ended so the casing will fill with fluids as it is lowered to and into the well.

26. The method of claim 24 comprising installing an automatic casing fill-up float shoe on the casing so the casing fills with fluids as it is lowered to and into the well.

27. The method of claim 24 further comprising providing the 13⅜" casing string with a 13⅜" casing hanger and landing the hanger in a subsea wellhead housing, the casing hanger having an internal bore with a landing means for landing a subsequent casing hanger on a casing string, whereby the subsequent casing hanger and casing string may pass through the reduced diameter riser.

28. The method of claim 27 wherein the landing means on the 13⅜" casing hanger is a landing shoulder.

29. The method of claim 27 further comprising running a second casing string through the reduced diameter riser and landing its casing hanger in the bore of the 13⅜" casing hanger.

30. The method of claim 24, further comprising the step of using motion compensation to effect disconnection, reconnection, and stabbing operations.

31. The method of claim 24, further comprising the use of an auxiliary hoist to lower the 13⅜" casing to the blowout preventer stack and into the well.

32. The method of claim 24 wherein the step of repositioning the riser over a secondary support mandrel on the blowout preventer stack further comprises restricting the lateral movement of the lower marine riser package by a pathway provided in a guide frame attached to the blowout preventer stack.

33. A riser system for connecting a subsea blowout preventer stack to an offshore drilling vessel comprising:

a) a riser pipe extending from the drilling vessel to a lower marine riser package connector;

b) a blowout preventer stack having a lower marine riser package mandrel wherein the lower marine riser package connector may be releasably connected to the lower marine riser package mandrel;

c) a secondary support mandrel wherein the lower marine riser package connector may be releasably connected to the secondary support mandrel; and d) a guide frame assembly comprising a guide frame attached to the blowout preventer stack, a guide pin attached to the lower marine riser package connector, the guide pin retained within a slot form in a guide plate, the guide plate being attached to the guide frame by one or more pivotable arms wherein the slot in the guide plate restricts the vertical movement of the lower marine riser package connector relative to the blowout preventer stack and the arms restrict the lateral movement of the lower marine riser package connector between the lower marine riser package mandrel and the secondary support mandrel to maintain the axial alignment of the riser during movement of the riser between the lower marine riser package mandrel and the secondary support mandrel.

34. The riser system of claim 33 wherein the guide frame assembly further comprises a hydraulic actuating ram attached to the guide frame at one end and attached to an arm on the other end wherein the ram can be actuated to laterally move the arm from the lower marine riser package mandrel to the secondary support mandrel.

35. The riser system of claim 34 wherein the ram can be actuated to laterally move the lower marine riser package connector from the secondary support mandrel to the lower marine riser package mandrel.

36. A method of running casing from an offshore vessel to a subsea wellhead comprising the steps of:

a) providing a lower marine riser package connector on the end of the reduced diameter riser to connect the riser to a lower marine riser mandrel on a blowout preventer stack, the blowout preventer stack being attached to the top of a subsea wellhead housing;

b) disconnecting the lower marine riser package connector from the lower marine riser mandrel;

c) repositioning the riser over a secondary support mandrel on the blowout preventer stack;

d) connecting the lower marine riser package connector to the secondary support mandrel;

e) providing choke and kill lines, hydraulic power and control lines extending from the drilling vessel to the blowout preventer stack, wherein such lines remain functional when the lower marine riser package connector is disconnected from the lower marine riser mandrel and reconnected to the secondary support mandrel;

f) lowering a first casing string outside of the riser through the blowout preventer stack and into the well;

g) landing a casing hanger for the first casing string in the subsea wellhead housing, the casing hanger having an internal landing means in the bore of the hanger;

h) releasing the lower marine riser package connector from the secondary support mandrel and reconnecting the lower marine riser package connector to the lower marine riser package mandrel on the blowout preventer;

i) lowering a second casing string through the riser and into the well; and j) landing the casing hanger for the second casing string on the internal landing means of the first hanger.

37. The method of claim 36 further comprising providing a lifting and guide frame assembly comprising an upper lifting frame connected to the lower marine riser package connector and a lower guide frame connected to the blowout preventer stack, wherein the lower marine riser package connector and the upper lifting frame are vertically and laterally moveable about a slot formed in the lower guide frame to maintain the axial alignment of the riser for moving the riser between the lower marine riser package mandrel and the secondary support mandrel.

38. The method of claim 37 further comprising attaching one or more hydraulic rams between the upper lifting frame and the lower guide frame and driving the lower marine riser package connector and the upper lifting frame between the lower marine riser package and the secondary return mandrel.

39. The method of claim 38 further comprising providing a lifting and guide frame assembly having an upper lifting frame connected to the lower marine riser package connector and a lower guide frame connected to the blowout preventer stack, wherein the lifting frame restricts the vertical movement of the lower marine riser package connector and the guide frame restricts the lateral movement of the lower marine riser package connector to maintain the axial alignment of the riser and control the movement of the riser between the lower marine riser package mandrel and the secondary support mandrel.

40. The method of claim 36 further comprising providing a guide frame assembly having a guide frame attached to the blowout preventer stack, a guide pin attached to the lower marine riser package connector, the guide pin being retained within a slot formed in a guide plate, the guide plate being attached to the guide frame by one or more pivotable arms wherein the slot in the guide plate restricts the vertical movement of the lower marine riser package connector relative to the blowout preventer stack and the arms restrict the lateral movement of the lower marine riser package connector between the lower marine riser package mandrel and the secondary support mandrel to maintain the axial alignment of the riser during movement of the riser between the lower marine riser package mandrel and the secondary support mandrel.

41. The method of claim 40 further comprises providing the guide frame assembly with a hydraulic accuating ram attached to the guide frame at one end and attached to an arm on the other end and accuating the ram to laterally move the lower marine riser package connector from the lower marine riser package mandrel to the secondary support mandrel.

42. The method of claim 41 further comprising accuating the ram to laterally move the lower marine riser package connector from the secondary support mandrel to the lower marine riser package mandrel.

43. The method of claim 36 further providing a guide frame assembly attached to the blowout preventer stack wherein the lower marine riser package connector extends through a slot in the guide frame assembly, wherein the vertical and lateral movement of the lower marine riser package connector is restricted by the slot in the guide frame assembly to maintain the axial alignment of the riser during movement of the riser between the lower marine riser package mandrel and the secondary support mandrel.

44. The method of claim 36 further comprising the step of using motion compensation to affect disconnection and reconnection operations.

45. The method of claim 36, further comprising the use of an auxiliary hoist to lower the casing string to the blowout preventer stack and into the well.

46. The method of claim 36 further comprising running the second casing string and its casing hanger through the reduced diameter riser.

47. The method of claim 36 further comprising locking down the casing hanger for the second casing string in the bore of the first hanger.

48. The method of claim 36 further comprising lowering a third casing string and its casing hanger through the riser and into the well and landing the third casing hanger in the bore of the first hanger.

49. The method of claim 48 further comprising stacking the third casing hanger upon the second casing hanger.

50. The method of claim 36 wherein the first casing string has an outer diameter of 13⅜" inches and the second casing string has an outer diameter of 9⅝" inches.

51. A method of drilling an offshore well from a drilling vessel having a reduced diameter riser for connecting the vessel to the well comprising the steps of:

a) providing a lower marine riser package connector on the end of the reduced diameter riser to connect the riser to a lower marine riser mandrel on a blowout preventer stack;

b) providing a guide frame assembly attached to the blowout preventer stack wherein the lower marine riser package connector extends through a slot in the guide frame assembly;

c) disconnecting the lower marine riser package connector from the lower marine riser mandrel and repositioning the riser over a secondary support mandrel on the blowout preventer stack, wherein the vertical and lateral movement of the lower marine riser package connector is restricted by the slot in the guide frame assembly to maintain the axial alignment of the riser during movement of the riser between the lower marine riser package mandrel and the secondary support mandrel; and d) connecting the lower marine riser package connector to the secondary support mandrel.

52. A deep ocean drilling system for drilling an offshore well from a drilling vessel comprising:

a) a reduced diameter marine riser extending from the drilling vessel to a lower marine riser package connector;

b) a blowout preventer stack having a lower marine riser package mandrel, wherein the lower marine riser package connector may be releasably connected to the lower marine riser package mandrel;

c) a secondary support mandrel wherein the lower marine riser package connector may be releasably connected to the secondary support mandrel; and d) a guide frame connected to the blowout preventer stack, wherein a pathway in the guide frame restricts the lateral movement of the lower marine riser package connector to maintain the axial alignment of the riser and control the movement of the riser between the lower marine riser package mandrel and the secondary support mandrel.

53. The method of claim 52 further comprising choke and kill lines, hydraulic power and control lines extending from the drilling vessel to the blowout preventer stack, wherein such lines remain functional when the lower marine riser package connector is disconnected from the lower marine riser mandrel and transferred and reconnected to the secondary support mandrel.

54. The method of claim 53, wherein the choke and kill lines, hydraulic power and the control lines remain functional when the lower marine rise package connector is disconnected from the secondary support mandrel and transferred and reconnected to the lower marine riser mandrel.

55. The method of claim 54, wherein the choke and kill lines, hydraulic power and control lines are protected from mechanical damage when the lower marine riser package connector is disconnected from the secondary support mandrel and transferred and reconnected to the lower marine mandrel.

56. The method of claim 53, wherein the choke and kill lines, hydraulic power and control lines are protected from mechanical damage when the lower marine riser package connector is disconnected from the lower marine riser mandrel and transferred and reconnected to the secondary support mandrel.

57. The method of claim 53, wherein the choke and kill lines, hydraulic power and control lines are releasably connected to the blowout preventer stack.

58. The method of claim 52, wherein the guide frame is releasably connected to the blowout preventer stack.

59. A retrievable lifting and guide frame assembly for drilling an offshore well from a floating drilling vessel comprising an upper lifting frame connected to a lower marine riser package connector and a lower guide frame connected to a subsea blowout preventer stack, wherein the lower marine riser package connector and the upper lifting frame are vertically and laterally moveable about a slot formed in the lower guide frame to maintain the axial alignment of the lower marine riser package connector and a marine riser connected to the lower marine riser package connector and extending from the floating drilling vessel and to provide a pathway for controlled movement of the riser and lower marine riser package connector between a lower marine riser package mandrel on a blowout preventer stack and a secondary support mandrel laterally removed from the lower marine riser package mandrel.

* * * * *